United States Patent [19]

Burke et al.

[11] Patent Number: 4,808,988

[45] Date of Patent: Feb. 28, 1989

[54] DIGITAL VECTOR GENERATOR FOR A GRAPHIC DISPLAY SYSTEM

[75] Inventors: Gregory M. Burke; Michael E. Jones, both of San Diego, Calif.

[73] Assignee: Megatek Corporation, San Diego, Calif.

[21] Appl. No.: 600,106

[22] Filed: Apr. 13, 1984

[51] Int. Cl.[4] ..... G09G 1/00

[52] U.S. Cl. ..... 340/744; 340/729; 340/745; 340/736; 364/522

[58] Field of Search ..... 340/736, 739, 741, 742, 340/744, 745, 729; 364/522

[56] References Cited

U.S. PATENT DOCUMENTS

| | | | |
|---|---|---|---|
| 3,996,585 | 12/1976 | Hogan et al. | 340/747 |
| 4,027,148 | 5/1977 | Rosenthal | 340/741 X |
| 4,212,009 | 7/1980 | Adleman et al. | 340/728 |
| 4,222,048 | 9/1980 | Johnson | 340/736 X |
| 4,225,861 | 9/1980 | Langdon, Jr. et al. | 340/703 |
| 4,371,872 | 2/1983 | Rossman | 340/728 |
| 4,386,345 | 5/1983 | Narveson et al. | 340/745 X |
| 4,386,349 | 5/1983 | Granberg | 340/724 X |
| 4,415,889 | 11/1983 | Davis | 340/728 |
| 4,475,104 | 10/1984 | Shen | 340/729 |
| 4,481,509 | 11/1984 | Sasaki et al. | 340/728 |
| 4,484,188 | 11/1984 | Ott | 340/733 X |
| 4,499,457 | 2/1985 | Hintze | 340/739 X |

OTHER PUBLICATIONS

Smith, Alvy Ray, "Tint Fill"; *Computer Graphics,* (ACM) vol. 13, No. 2, pp. 276–283 (Aug. 1979).

*Primary Examiner*—Gerald L. Brigance
*Assistant Examiner*—Jeffery A. Brier
*Attorney, Agent, or Firm*—Scherlacher, Mok, Roth

[57] ABSTRACT

A graphics display system digital vector generator system includes three position vector generators generating position information for each of three different pixel location dimensions and three visual characteristic vector generators operating synchronously with the position vector generators to generate dynamic intensity information for three different dimensions of visual characteristics. Optical processing of visual characteristic vectors includes normalization to generate Phong shading intensity vectors, pattern shape generation, and mixing of hue and intensity information with selectable resolution to obtain a desired visual characteristic pixel data representation.

20 Claims, 11 Drawing Sheets

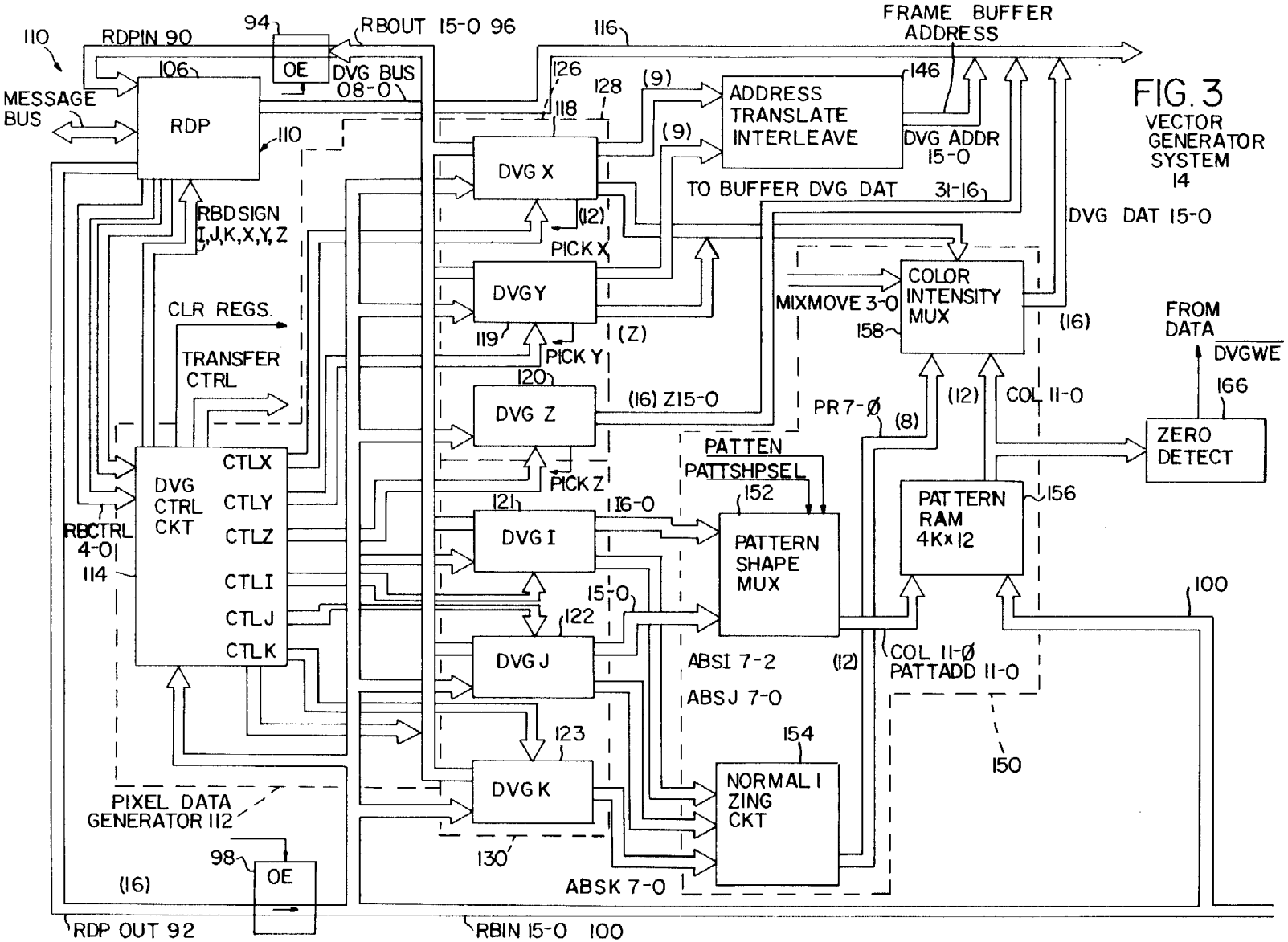
FIG. 3
VECTOR GENERATOR SYSTEM 14
FROM DATA
DVGWE
166
ZERO DETECT
100
DVG DAT 15-0
(16)
COL 11-0
156
PATTERN RAM 4Kx12
150
COL 11-Ø PATTADD 11-0
FRAME BUFFER ADDRESS
146
DVG ADDR 15-0
31-16
COLOR INTENSITY MUX
(12)
(8)
158
MIXMOVE 3-0
PR 7-Ø
ADDRESS TRANSLATE INTERLEAVE
TO BUFFER DVG DAT
PATTEN
PATTSHPSEL
152
PATTERN SHAPE MUX
(12)
154
NORMAL I ZING CKT
ABSI 7-2
ABSJ 7-0
(9)
(9)
(16) Z15-0
(Z)
116
128
126
118
(12)
PICK X
PICK Y
PICK Z
I 16-0
15-0
122
123
ABSK 7-0
DVG X
DVG Y
DVG Z
DVG I
DVG J
DVG K
120
119
121
130
RBIN 15-0 100
RBOUT 15-0 96
DVG BUS 08-0
OE
94
110
RDP
106
RDPIN 90
RBDSIGN I,J,K,X,Y,Z
CLR REGS.
TRANSFER CTRL
CTLX
CTLY
CTLZ
CTLI
CTLJ
CTLK
DVG CTRL CKT
RBCTRL 4-0
114
PIXEL DATA GENERATOR 112
OE
98
(16)
RDP OUT 92
110
MESSAGE BUS

X DVG 118

Z DVG 120

I DVG 121

DVG CTRL CKT
114

COLOR INTENSITY
MULTIPLEXER 158

DIGITAL VECTOR GENERATOR FOR A GRAPHIC DISPLAY SYSTEM

BACKGROUND OF THE INVENTION

1. Field of the Invention

This invention relates to a digital vector generator system for graphic displays and more particularly to such a system having three visual characteristic vector generators operating synchronously with spatial vector generators to generate multi-dimensional visual characteristic vectors.

2. Discussion of the Prior Art

Graphical image display systems provide an array of discrete points known as pixels at which emitted light intensities may be independently controlled. Each pixel may represent a single intensity for a monochrome system or three different primary color intensities for a three color system.

A display is generated by effectively sampling light intensities at each point of a source image which corresponds to a display pixel and then illuminating each pixel in accordance with its corresponding sampled light intensity value. In the case of a computer generated image the pixel light intensity values are generated by a computer as a prediction of what the values would be if sampled from an actual image of a selected object under selected light conditions.

Raster scan display systems typically provide a two dimensional rectangular array of pixels arranged in rows and columns. A frame buffer stores intensity values for each pixel in a location which may be addressably accessed in response to the row and column position of the pixel within the array. As a controlled beam scans the pixel array row by row, the corresponding illumination data is read from the frame buffer and used to control the intensity of the scanning beam at each pixel and hence the corresponding illumination intensity of the pixel.

Video image data is typically provided to a digital vector generator as lists of lines or polygons defined by end points and corners or line slopes. Visual characteristic information is provided for each line or polygon as part of the test. The spatial information is utilized to initialize digital vector generators which then proceed to generate spatial address locations which define each line of a display as a plurality of adjacent pixel points. The vector generators generate address information defining X, Y and Z coordinates which locate the line in three dimensional display space.

A frame buffer store is provided having an address location corresponding to each pixel location in a display image. Visual characteristic information defining the visual display characteristics of each pixel must be stored at the address corresponding to the pixel. The visual characteristic information may have different portions defining intensity and hue, may have different portions defining Red, Green and Blue (RGB) color intensities, or may have information which is to address a color map table to produce the desired visual characteristic information.

While the digital vector generator determines the X, Y and Z coordinates for a next point on a line, a central processing unit must also determines the visual characteristic information for the next point. When both the visual characteristic information and spatial address information are available, the spatial address information is used to address the frame buffer and the visual characteristic information is written into the selected address location.

Because of the large number of pixels which comprise a video display, for example, $768 \times 525 = 403{,}200$, a considerable period of time may be required to generate all of the pixel data for a display image. Several minutes may be required to generate an image using sophisticated shading algorithms such as Phong shading or Gouraud shading. Various shading and texturizing techniques are described in the following references.

Smith, Alvy Ray, "Tint Fill", *Computer Graphics*, (ACM) Vol. 13, No. 2, pp. 276–283 (August, 1979), discloses an algorithm for filling a bounded area. The algorithm is specially adapted to handle graduated shading at line edges which is said to be introduced by all antialiasing techniques.

U.S. Pat. No. 4,225,861, "Method and Means for Texture Display in Raster Scanned Color Graphic System", Langdon, Jr. et al, discloses a graphic system including a color map table and a texture RAM which is capable of producing a texturized surface. However, the disclosed system does not provide the broad range of selectable operating modes that are available with the present arrangement.

A Single dimension vector generator is disclosed in U.S. Pat. No. 3,996,585 to Hogan et al. Integer steps are assumed in the vertical direction while the generator produces horizontal dimension pixel data. A Z dimension cannot be accommodated and the vector generator is used only for spatial information, not color intensity information.

U.S. Pat. No. 4,212,009, "Smoothing a Raster Display", Adleman et al teach an arrangement in which the width of the raster beam is varied in accordance with the data being displayed.

SUMMARY OF THE INVENTION

A high speed graphics display digital vector generator system in accordance with the invention includes a three dimensional spatial digital vector generator as well as a three dimensional visual characteristic digital vector generator coupled to operate synchronously therewith. A vector processing subsystem responds to the generated visual characteristic vector information with a wide range of selectable alternatives.

The vector processing system includes a normalizing circuit coupled to receive the three visual characteristic vectors and generate a normalized intensity value suitable for use in Phong shading in response thereto. A pattern shape multiplexer responds to two of the visual characteristic vectors by generating an output signal that is representative of a selected resolution of each of the received vectors. A writeable pattern RAM is coupled to be addressed by the output of the pattern shape multiplexer to generate an output signal that may be advantageously used to represent hues in any selected solid or textured pattern. Because the visual characteristic vector generators operate synchronously with the spatial vector generators, hue patterns within the texture RAM may be readily correlated with spatial patterns in the displayed video image.

A color intensity multiplexer is coupled to received output data from the pattern RAM and from the normalizing circuit and combine the outputs into selected data patterns for storage in a frame buffer for request output to a video display device. The color intensity multiplexer is particularly advantageous when used to combine intensity information from the normalizing circuit with hue information from the pattern RAM to form a pixel display data word having a selected resolution for each of the two constituents.

BRIEF DESCRIPTION OF THE DRAWINGS

A better understanding of the invention may be had from a consideration of the following detailed description taken in conjunction with the accompanying drawings, in which:

FIG. 3 is a block diagram representation of a digital vector generator subsystem used in the system shown in FIG. 1;

DETAILED DESCRIPTION

Figure 1:
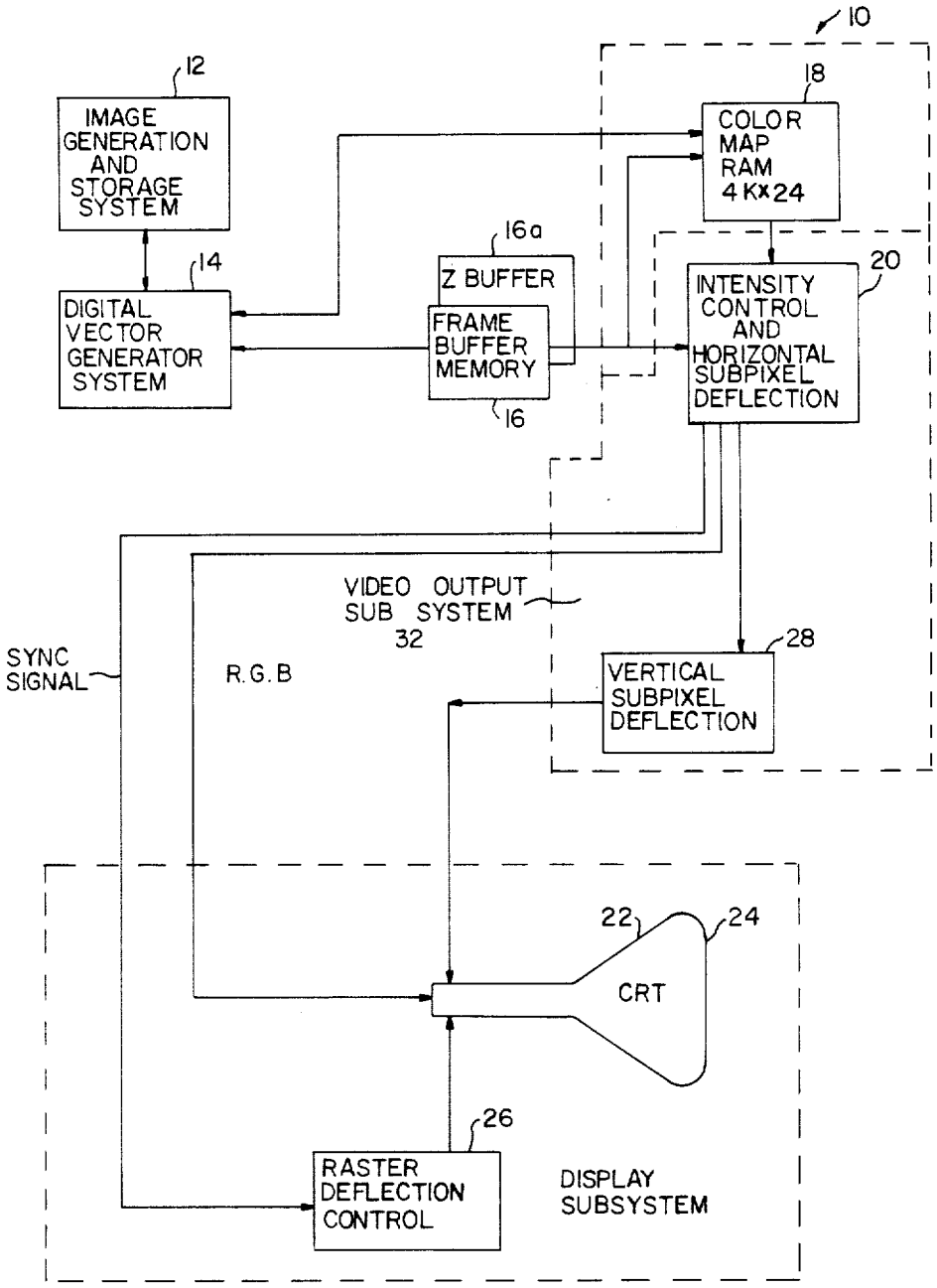
FIG. 1 is a block diagram and schematic representation of a graphic image generating system in accordance with the invention.

Referring now to FIG. 1, there is shown a raster scan graphic image generating system 10 having an image generation and storage system 12 providing a source of images to be displayed. The image generation and storage system 12 may be conventional in nature and in a typical system includes a data base storing the display list for each image to be displayed, communications interface circuits, and peripheral controller circuits including data entry devices such as keyboards, data tablets, and joy sticks.

A digital vector generator system 14 receives lists of image definition data from image generation and storage system 12 and converts such data to an array of pixels defining a display image. The array of pixels is communicated to, and then stored in, a frame buffer memory 16. In the present example, the frame buffer memory 16 includes storage for a two-dimensional 768×576 array of pixels which is deemed to have an origin at the upper lefthand corner of a rectangular image with a Y axis extending positive downward and an X-axis extending positive to the right. For each pixel location within the buffer memory 16, there are stored 12 bits of video information as well as two bits of subpixel X address information and two bits of subpixel Y address information.

Also contained within the frame buffer memory 16 is a Z-buffer 16*a* having a pixel location corresponding to each pixel location of the video display buffer memory and storing third dimension or Z-axis position information for each pixel position in a display. The Z-axis is deemed to extend from the origin lying in the plane of the display screen positively away from the viewer perpendicular to the X and Y axes. Upon transfer of a pixel of information to the frame buffer memory 16, the current Z or depth value is retrieved from the addressed pixel location within the Z-buffer 16*a* and compared to the Z value of the new data. Initially the Z buffer 16*a* is set to a maximum positive value of 65, 535 (for $2^{16-1}$). If the Z value of the new data has a selected functional relationship to pre-existing old data such as being less than or equal to the Z value of the old data, indicating that the new data is at least as close to the viewer as the old data, then the new data is written into the frame buffer memory 16 with the Z coordinate value being written into the Z buffer 16*a* and the video display intensity and X, Y subpixel address data being written into the frame buffer 16. If the Z value of the new data is greater than the previously stored Z value at the indicated pixel address, (indicating that the new data is farther away from the viewer and hidden by a surface defined by the previously stored data) then writing of the new data into the frame-buffer memory 16 is inhibited and the new data is discarded. In this way, only visible surfaces are actually written into the frame buffer memory 16 and a separate operation is not required to distinguish visible surfaces from hidden surfaces to complete the proper assembly of an array of pixels for a visible image. The Z buffer inhibit function may be selectively enabled or disabled in accordance with a desired operating mode.

Within the frame buffer there are 52 bit planes forming two display buffers and a single Z buffer 16*a*. Each display buffer contains 12 intensity planes, 4 subpixel address planes and 2 overlay planes for text or cursors. The single Z-buffer 16*a* stores depth coordinates. Only a first frame buffer can be addressed by the DVGs, but either buffer can be read by the video output subsystem. In normal operation, the second frame buffer is continuously read to refresh the display subsystem while the first buffer is updated. After the first buffer has been updated, the data is transferred into the second buffer. During this transfer period, the video output subsystem reads the first buffer.

To convert the data pixels stored by frame buffer memory 16 to a visible image, the frame buffer memory 16 is accessed in raster scan order with the 12 bits of video display data being communicated to a color map RAM 18 which performs a transformation that converts the video data to a predetermined three color RGB representation with 8 bits maximum per color. Color map RAM 18 functions as a color look-up table that is loaded from image generation and storage system 12. This allows a particular intensity and hue to be assigned to a given pattern of bits at a selected address within frame buffer 16.

An intensity control and horizontal subpixel deflection circuit 20 receives the RGB color intensity information from color map RAM 18 and the X and Y subpixel address information from frame buffer memory 16 for use in generating display control signals including three visual characteristic signals representing the RGB color intensity input to a cathode ray tube 22 which displays the stored image on the face 24 thereof and a set of vertical displacement signals which command the vertical displacement of a displayed pixel. CRT 22 has a precision in-line (PIL) gun that emits three parallel electron beams that lie within a plane parallel to the horizontal raster scan direction. The intensity control and horizontal subpixel deflection circuit 20 displaces each pixel in the X or horizontal direction by quarter pixel increments according to the magnitude of the two bits of subpixel X address data received from frame buffer memory 16. Because the raster beam scans the face 24 of CRT 22 at a uniform velocity, subpixel displacement of a given pixel can be controlled in the horizontal direction by varying the time at which the 24 bits of RGB color information are actually applied to the color intensity control of CRT 22. To move a pixel to the left of its normal position, the data corresponding thereto is applied to the CRT 22 somewhat earlier than usual and to move the pixel to the right, the data is applied to the CRT 22 somewhat later than usual. A raster deflection control circuit 26 is coupled to drive CRT 22 with a normal raster scan and is not affected by the X and Y subpixel addressing which is superimposed upon the normal raster scan of the electron beams upon the face 24 of CRT 22.

Subpixel displacement of the scanning electron beam in the vertical direction is accomplished by a small horizontal magnetic field. Four pairs of single turn windings are placed beneath the conventional deflection coils of CRT 22. The first winding of each pair (4 parallel single turn windings) is placed on one side of CRT 22 in a coaxially wound relationship between existing deflection yoke and the CRT funnel, while the second winding of each pair is similarly placed on the opposite side of CRT 22. The connection of only two turns in series in each winding results in a very low inductance fast response subpixel deflection system. The arrangement increases sensitivity by enabling the low reluctance magnetic return path of the main vertical deflection system to be used for the subpixel deflection system as well.

The nomenclature for subpixel addressing is complicated by a need to minimize the bits of storage required to represent each subpixel address, the need to avoid negative number representations and the need for a unidirectional subpixel vertical displacement current with a small steady state value. To meet conflicting requirements, different reference axes are used at different points in the image generating system 10.

Within the image generation and storage system 12 a world X Y Z coordinate system is used with the origin at the center of the image. An image is stored as a display list in which the image is represented by a list of individual line segments of standard shapes such as straight lines and circular curves. Line segments are defined within a three dimensional Euclidean space with a resolution of ± bits on each axis.

Frequently only a portion or window within a display list will be displayed on the face 24 of CRT 22. As a display list is transferred from the image generation and storage system 12 to the digital vector generator 14, portions of the list outside the selected display window are clipped or removed and a transformation is made by the digital vector generator system 14 to a display coordinate system. The display coordinate system places the origin at the upper lefthand corner of the display image with the positive X axis extending to the right and the positive Y axis extending downward. This convention conforms to the non-interlaced raster scan which is used to paint the display image on the face 24 of CRT 22.

Use of two bits each to define the X and Y subpixel addresses results in 4 discrete subpixel address locations in each dimension for each pixel. The four steps are numbered in binary sequence 00, 01, 10, 11 from top to bottom in the Y direction and left to right in the X direction. The value 10 is assigned to the normal or background subpixel location. This enables a given pixel to be selectively shifted to the right (or upward) by one or two quarter pixel increments or to the left (or downward) by one quarter pixel increment.

In the X direction the subpixel address adjusts the starting time (or left edge) of the pixel. The location is changed by starting the pixel display slightly earlier or slightly later. However, in the Y direction, special subpixel deflection coils must be added and driven with subpixel deflection currents.

However, it is expensive to implement bipolar deflection currents with a very high frequency response. For this reason the subpixel deflection coils and currents are implemented to deflect pixels vertically upward only 0, 1, 2 or 3 quarter pixel increments from the normal raster scan position in response to binary commands of 00, 01, 10, 11, respectively.

In the absence of negative subpixel deflection currents a subpixel deflection of ¼ is established as the normal or background position. The effect is to shift the entire displayed image vertically upward by one-fourth pixel. This is not noticeable to the viewer and requires a relatively small steady state current to drive the subpixel deflection coils. From the background position each given pixel can be shifted down ¼, up ¼ or up ½ pixel position. These actual physical locations now match the subpixel address commands, although a transformation is required between the addresses and the subpixel deflection current commands. These states are summarized in Table 1 below.

TABLE 1

| Displacement | Subpixel Address | Current Command |
|---|---|---|
| Up ½ | 00 | 11 |
| Up ¼ | 01 | 10 |
| Zero | 10 | 01 |
| Dn ¼ | 11 | 00 |

It can be observed from Table 1 that the transformation from the subpixel address to the current command turns out to be just a logical inversion. It will be remembered that point zero in Table 1 actually corresponds to a displacement vertically upward of ¼ pixel relative to the normal deflection coil location of a pixel.

A vertical subpixel deflection circuit 28 receives the two bits of Y subpixel address information from frame buffer memory 16 through the intensity control and horizontal subpixel deflection circuit 20 and selectively drives the vertical subpixel deflection coils in response thereto. The color map RAM 18, intensity control and horizontal subpixel deflection circuit 20 and vertical subpixel deflection circuit 28 form a display control system 30 which drives the CRT 22 to control the visual characteristics and position of each visual picture element of a displayed video image. The intensity control and horizontal subpixel deflection circuit 20 and the vertical subpixel deflection circuit 32 within the display control system 30 form a video output subsystem 32. The video output subsystem 32 operates to repetitively update CRT 24 with information received from frame buffer 16 and color map RAM 18 to maintain a continuous visual display.

At pixels defining lines and edges, the subpixel address may be changed from the normal 2, 2 value as necessary to provide smoother edges and to reduce aliasing. Thus a subpixel address value of 0, 0 would move the displayed pixel location one-half of a pixel distance vertically higher and one-half of a pixel distance horizontally to the left while a subpixel address value of 1, 2 would move the pixel by one-fourth of a pixel distance horizontally to the left without changing the normal vertical displacement. A value of 2, 2 is the normal display position and a value of 3, 3 moves the pixel by one-fourth of a pixel distance horizontally to the right and one-fourth pixel distance vertically downward relative to the normal background display position. It will be appreciated that X and Y subpixel addresses independently control the horizontal and vertical deflection so that each pixel may be selectively deflected by a selected quarter pixel increment either horizontally or vertically or both.

Vector end-points are always located with (2,2) bcas. Due to the nature of the DVGs, addresses between end points are always (n,2) or (2,m) depending upon which axis is the major axis. The major axis subpixel address is always selected to be 2.

Figure 2:
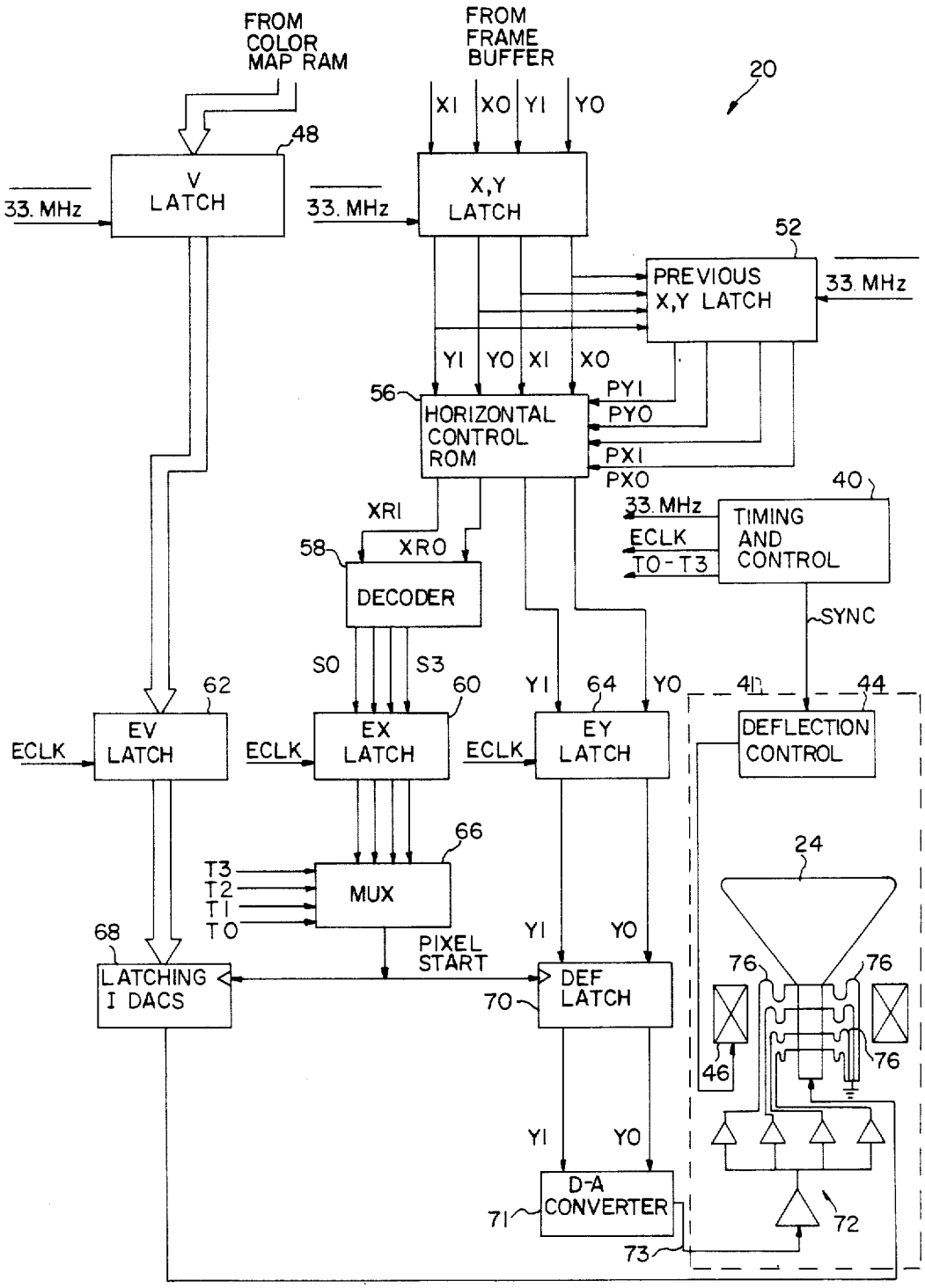
FIG. 2 is a block diagram and schematic representation of a video output and display subsystem used in the system shown in FIG. 1.

Referring now to FIG. 2, the intensity control and horizontal subpixel deflection circuit 20 is represented in a somewhat simplified form. Frame buffer display architectures are well known and therefore much of the conventional circuitry required to access the frame buffer memory 16 in raster scan order, read out the pixel data, and cause the face 24 of CRT 22 to be illuminated with the pixel data has not been explicitly shown. Only that portion of the deflection circuit 20 which relates to horizontal and vertical subpixel deflection of the normal pixel display position is illustrated in detail.

A timing and control circuit 40 generates the master timing and synchronization signals for operation of monitor 41 including CRT 22. These signals include a synchronization signal which is communicated to the deflection control circuit 44 which controls the raster scanning of a beam across the face 24 of CRT 22 in a conventional manner. In the present example a set of magnetic deflection coils 46 produce a conventional raster display pattern although alternative deflection means such as electrostatic deflection plates or other display technology could be employed.

Timing and control circuit 40 generates a pixel rate clock signal 33 MHz/ which is used to latch color intensity and subpixel address data received from color map RAM 18 and frame buffer memory 16. Timing and control circuit 40 also generates at the 33. MHz pixel clock rate a signal ECLK which is utilized to latch the intensity and subpixel address data after processing in a pipeline type of arrangement. Timing and control circuit 40 also generates at the pixel rate a set of four timing signals T0–T3 at the 33 MHz pixel rate, but having relative phase relationships displaced at quarter pixel time intervals (7.5 nanoseconds) to control the times at which color intensity data is applied to CRT 22 and hence the exact quarter pixel horizontal position of the corresponding video pixel image.

A V latch 48 responds to clock signal 33 MHz/ to latch the 24 bits of three color, video intensity data while an X, Y latch 50 latches the four bits of X and Y subpixel address data and a previous X, Y latch 52 latches the immediately preceding four bits of X, Y subpixel address data.

A horizontal control ROM 56 receives the current pixel and previous pixel subpixel address information as address inputs and outputs horizontal displacement control information defining the effective subpixel address commands in response thereto. The Y subpixel information output by horizontal control ROM 56 represents a straight passthrough of the current Y subpixel address information. However, the X subpixel address information output by horizontal control ROM 56 represents a selected blending of the previous and current X, Y subpixel address offsets so as to achieve a positional averaging effect at line or edge boundary intersections.

Many existing systems handle discontinuities which occur as two intersecting lines attempt to share a single pixel by displaying the pixel as a weighted average of the two or more colors attempting to share the pixel in proportion to the portion of the pixel theoretically occupied by each color. This color blending tends to degrade the dynamic resolution of the display and is aesthetically unsatisfactory for color mapped systems having a limited continuity of the various colors.

Instead of attempting to dynamically blend the different colors of two intersecting lines or edges, the horizontal control ROM 56 uses subpixel addresses of adjacent horizontal pixels to set the spatial boundary between the pixels so as to produce an aesthetically pleasing image while retaining the full dynamic visual acuity and resolution of the imaging system. As a general rule, line or boundary pixel edges are treated as dominant and conflicting background pixel edges are moved to conform to the subpixel deflection of line or edge pixels.

Tables 2A–2D show the response of the horizontal control ROM 56 to the preceding and current subpixel addresses Y1Y0X1X0. Xp and Xc are the decimal values of the preceding and current subpixel address bits X1X0. Yp and Yc are the decimal values of Y1Y0 preceding and current address bits.

TABLE 2A

| | Yc and Yp not equal to 2 | |
|---|---|---|
| | | Xp |
| | | 0123 |
| Xc | 0 | 0112 |
| | 1 | 1122 |
| | 2 | 1223 |
| | 3 | 2233 |

TABLE 2B

| | Yc=2, Yp not equal to 2 | |
|---|---|---|
| | | Xp |
| | | 0123 |
| Xc | 0 | 0112 |
| | 1 | 1122 |
| | 2 | 0123 |
| | 3 | 2233 |

TABLE 2C

| | Yc not equal to 2, Yp−2 | |
|---|---|---|
| | | Xp |
| | | 0123 |
| Xc | 0 | 0002 |
| | 1 | 1112 |
| | 2 | 1123 |

TABLE 2C-continued

| Yc not equal to 2, Yp−2 | |
|---|---|
| | Xp 0123 |
| 3 | 2233 |

TABLE 2D

| Yc−Yp−2 | |
|---|---|
| | Xp 0123 |
| Xc 0 | 0102 |
| 1 | 1112 |
| 2 | 0123 |
| 3 | 2233 |

It will be recalled that a subpixel address value of 2 indicates a background or fill pixel which is displayed at a normal pixel position. Such pixels thus tend to indicate a background or fill position although a subpixel address of 2 can occur at a line or edge boundary if the best position for defining the boundary coincidentally happens to be the normal background position. In any event, the absence of a value of 2 (Y1,Y0=1,0 binary) from the Y subpixel address of both the current and previous pixel indicates that neither pixel is a background pixel, and suggests an intersection of two lines or edges.

In Tables 2A–2D the rows correspond in top to bottom order to current X subpixel address values of 0–3 decimal respectively while the columns correspond in left to right order to the previous pixel X subpixel address values of 0–3 decimal respectively. Look at the major diagonal of the array shown in Table 2A. It will be noted that where both the current and previous pixels have the same subpixel address, the output address from control ROM 56 is the same as the inputs. Where the previous and current pixels do not have the same subpixel X address, the current pixel effective X address is output approximately as an averaging of the previous and current pixel subpixel X addresses depending on the current and previous Y1Y0 address.

It should be noted at this point that the subpixel X addresses define the point at which the left edge of a pixel occurs by defining the time at which the corresponding color intensity data is applied to the CRT display. Once a pixel starts it continues until the occurrences of the next pixel by applying the color intensity information for the next pixel to the CRT display. There is consequently no gap between adjacent pixels in the horizontal direction. The width of each pixel is inherently varied to fill the allotted display space.

The X subpixel address output of horizontal control ROM 56 (designated XR1, XR0) is decoded by a binary decoder 58 and then latched by EX latch 60 in response to clock signal ECLK. At the same time, EV latch 62 latches the corresponding 24 bits of video color intensity information while an EY latch 64 latches the corresponding subpixel Y address information Y1, Y0 which has been passed through horizontal control ROM 56 unchanged. A multiplexer 66 receives the decoded effective X subpixel address information and the four sequentially phased timing signals T0–T3; and in response to these signals generates a pixel start clock signal which effectively defines the time occurrence and hence the spatial positioning on the video display of the left edge of each successive pixel.

Upon the occurrence of the signal pixel start, three 8 bit digital-to-analog converters, one for each of the R, G, B color components of the video signal, contained within a circuit designated latching I DACs 68 receive and latch the color intensity signal from EV latch 62. These latched color intensity signals are immediately converted to corresponding analog voltages and applied to the color intensity control inputs of the CRT 22 to immediately command the displaying of the latched video information. Simultaneously, signal pixel start causes a Y deflection latch 70 to receive and latch the Y subpixel address information from EY latch 64.

A digital-to-analog converter 71 responds to the digital Y1,Y0 subpixel offset signal output by Y deflection latch 70 to generate an analog signal on conductor 73 that is indicative of the subpixel displacement. DA converter 71 inherently provides the logic conversion that is required to convert the Y subpixel address signals to deflection current command signals. An amplifier 72 with four output stages responds to the analog deflection signal on conductor 71 and drives a current through the four coil pair in proportion thereto. A set of low inductance subpixel deflection coils 76 having four single turn coils on each side of CRT 22 is driven by the current outputs of buffer amplifier 72 to selectively deflect the scanning or electron beam vertically upward from the normal raster scan position. The 8 coils generate a uniform horizontal magnetic field across the three electron beams from the PIL gun of CRT 22. This causes equal vertical deflection of the three beams. As noted previously, negative subpixel address values are eliminated by utilizing a subpixel address value of 2 as the normal horizontal background position and a subpixel address value of 2 as the normal vertical background position. This background address value corresponds to a vertical offset of ¼ upward. The displayed pixel location can be moved vertically upward or downward from this normal background position relative to the +¼ pixel upward bias position.

In order for the vertical subpixel displacement of a given pixel to match the occurrence of the left boundary of the pixel at the time the video data corresponding thereto is latched by digital-to-analog converter 68 and becomes effective to control the display, it is necessary that the response rate of the amplifier 72 and the deflection coils 75 match the response rate of the color intensity controls of CRT 22. Because this response rate is very fast, the single turn coils 76, are utilized to reduce the inductance thereof and enable the response time of the subpixel vertical deflection system to match this very fast response of the intensity control system. The amplifier bandwidth can be trimmed at the time of manufacture to synchronize the subpixel vertical deflection with the intensity control.

As shown in FIGS. 1 and 3, the digital vector generator system 14 operates in response to vector defining information received from the image generation and storage system 12 to generate multi-bit digital words of pixel data representing video image pixels of vectors defined by the vector defining information. The digital vector generator system 14 includes raster display processor (RDP) 110 having input and output data buses RDPIN 90, and RDPOUT 92 which each carry 16 parallel data conductors along with control conductors and couple to raster board buses RBOUT 15-0 96 and RBIN 15-0 100 respectively, which interconnect the major system components of the image generation and storage system 12. The RDP input data bus 90 is coupled through a buffer 94 to bus RBOUT 96 while the RDP output bus 92 is coupled through a buffer 98 to bus RBIN 100. A 16K×16 data memory is included within raster data processor 110 to provide storage of object and vector definition data as well as working operands. A message bus with 16 data conductors and 8 control conductors provides communication between the raster data processor 110 and the image generation and storage system 12. Through the RDP input and output buses 90, 92 and their extensions RBOUT 96, RBIN 100 along with control lines, the raster data processor 110 (see FIG. 3) has communication access to the individual registers and memories of the visual characteristic pixel data generating portion 112 of the digital vector generator 14.

The raster data processor 110 receives image defining lists from the image generation and storage system 12 and processes these lists to obtain the data necessary to initialize the pixel data generator 112, which in turn generates the actual pixel data containing the dynamic color and intensity visual characterization for each line vector of a display image. The pixel data generator 112 basically operates between only two end points defining a single line vector at any one time. The raster data processor 110 breaks down complex image segments such as vertex defined, filled or unfilled polygons into line vector representations. Typically each object is represented by a series of boundary vectors defining the peripheral edges of the object and a series of fill vectors which are coincident with raster scan lines and define the interior of an object. The pixel data generator 112 is then utilized to generate the actual pixel data values and their display position addresses for these line vector representations.

The pixel data generator portion 112 of the digital vector generator 14 includes a digital vector generator control circuit 114 which generates the specific decoding, timing signals and control signals for clocking and enabling the various registers, memories and other circuit components of the pixel data generator 112 for the purpose of transferring data from one place to another. These data transfer techniques are conventional and in the interest of clarity have not been described in detail. However, the major control signals and the important timing relationships which enable the proper operation of the vector generator 112 are described specifically.

The digital vector generator system 14 is coupled to frame buffer memory 16 by a large bandwidth bus called the DVG bus 116. A set of 79 principal conductors comprising DVG bus 116 is arranged to carry 34 data signals DVGDAT 33-0, 16 address signals DVGADDR 15-0, 24 chip select signals DVGCS 23-0 and 5 frame buffer memory select signals FBMSEL 4-0. All except the data signals are actually addressing signals. The frame buffer memory select signals permit selection of the color components and two single bit overlay components of frame buffer 16, Z buffer 16a or color map RAM 18. The data signals include 16 bits of Z buffer 16a data DVGDAT 33-18, 2 bits of overlay memory data DVGDAT 17-16, 4 bits of X,Y subpixel address data DVGDAT 15-12, and 12 bits of main frame buffer memory 16 data DVGDAT 11-0. Conventional control and clock signals are also passed along the DVG bus conductors.

Raster data processor 110 is coupled to the DVG bus 116 to provide RDP 110 with complete control over the contents of the frame buffer 16, 16a for such functions as initialization and diagnostic analysis. During video display generation the pixel data generator 112 communicates pixel spatial addresses and visual characteristic information over the DVG bus 116 to frame buffer 16, 16a. Buses RBOUT 96 and RBIN 110 couple RDP 110 to the color map RAM 18 for initialization and diagnostic analysis.

The pixel data generator 112 includes six component digital vector generators 118–123 designated respectively DVG X, DVG Y, DVG Z, DVG I, DVG J and DVG K. Spatial address generators X, Y and Z 118–120 generate three dimensional positional address information while visual display characteristic generators I, J, K 121–123 generate three dimensional color and video intensity information. The two sets of generators form a vector generator subsystem 126 with an X, Y, Z spatial address portion 128 and an I, J, K dynamic color portion 130. The two portions 128, 130 are conceptually similar but have differences in their specific implementations.

Visual characteristic generator DVGs I,J and K 121–123 perform three primary functions. During Gouraud shading DVG K 123 interpolates intensity data between two end points. Phong shading produces a quadratic interpolation between end points and uses DVGs I,J and K. Texture is generated by slaving the I and J DVGs to the X,Y and Z DVGs and addressing the pattern RAM with the I and J DVGs.

A dynamic intensity processing circuit 150 couples the generated visual characteristic information to the DVG bus 116 with a large number of selectable combinations which afford the system operator an extensive collection of selectable operating modes. A pattern shape multiplexer 152 receives the 13 bits I 6-0, J 5-0 and selectively outputs 12 of the 13 bits to a 4K×12 pattern RAM 156. The output bits are selected as I 5-0, J 5-0 when signal PATTSHPSEL from a mode control register 258 is 1 and I 6-0, J 5-1 when signal PATTSHPSEL is zero. This enables color selection signals to be balanced between the I and J DVGs 121, 122 or to be weighted in favor of DVG I 121.

The selected 12 bits become address bits for the pattern RAM 156. If each work in pattern RAM 156 stores the value of its address then the address input signal is output to a color/intensity mixer 158 unchanged. Alternatively, the address input can be made to recycle with a selected period. If a selected visual pattern is stored in pattern RAM 158 at addresses corresponding to the repeating address pattern, pattern RAM 156 will output the pattern on a repetitive basis to provide a textured surface effect.

Further freedom in manipulating the visual characteristic pixel data is provided by the color/intensity multiplexer 158 which selects either 8 bits, PR 7-0 from normalizing circuit 154 or 12 bits COL 11-0, from pattern RAM 156, and outputs 12 bits, comprising a selected combination onto data conductors DVGDAT 11-0 of DVG bus 116. This permits, for example, a surface to be shaded or covered with a pattern, DVG control circuit 114 includes a DVG pixel counter 148 (shown in FIG. 7) along with functions such as decoding of register selection and enable signals and generation of control signals required for the operation of the pixel data generator 112. An address translate and interleave circuit 146 receives the X, Y integer pixel addresses from X, Y DVG 118, 119 in X, Y coordinate representations and converts these to a set of linear addresses that are compatible with data memories. A more detailed discussion of the various components of the vector generator system 14 is provided below.

Figure 4:
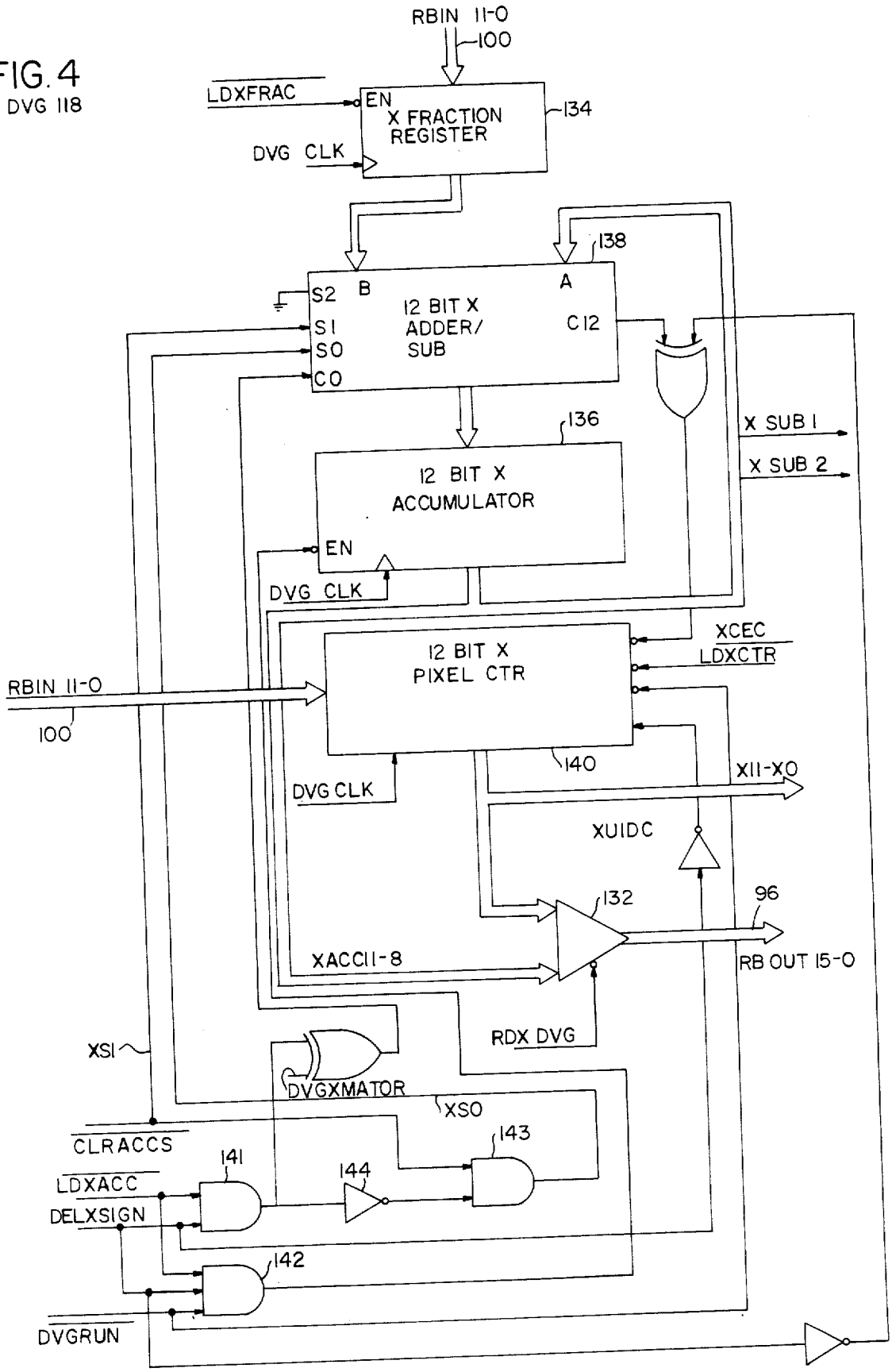
FIG. 4 is a block diagram representation of a single X dimension position digital vector generator used in the digital vector generation subsystem shown in FIG. 3.

The digital vector generator X 118, is illustrated in greater detail in FIG. 4. DVG X 118 includes a 12 bit X fraction register 134, a 12 bit X accumulator register 136 and a 12 bit X adder/subtractor 138 coupled to receive the output of X accumulator 136 as an A input, the output of X fraction register 134 as a B input, and to output the result thereof to the X accumulator 136. A 12 bit up/down X pixel counter 140 is coupled to be selectively incremented or decremented when its count enable input, CET, is enabled by a carry out output, C12, from adder/subtractor 138 which represents a carry out from the most significant bit when adding, or a borrow when subtracting. The C12 output of adder/subtractor 138 is exclusive OR-ed with the DELXSIGN/ signal to insure that carries are propagated for ADDs and borrows are propagated for subtractions. Counter 140 is coupled to be initialized with data from bus RBIN 11-0 100 under control of signal load X counter LDXCTR/, which is decoded in DVG control circuit 114 from a set of 5 binary RB destination control signals which are generated by RDP 110.

A 16 bit tristate X buffer 132 is coupled to place upon the RDP output bus 96 a 16 bit word when its output enable control is activated by a signal to read the X DVG, RDXDVG, which is decoded from the RB control signals. The 16 bit word is comprised of 12 bits from the X counter 140 and the most significant four bits, XACC 11-8; from X accumulator 136 which are placed in the four least significant bit positions by bus RBOUT 96. This coupling is useful for test and diagnostic purposes.

The X fraction register can be loaded from the RBIN 11-0 bus 100 under control of a signal load X fraction register, LDXFRAC, which is decoded from the RB destination select signals. The 12 bit adder/subtractor 138 is implemented from 74F382 integrated circuits and has three control inputs S0, S1 and S2 which control the operation thereof. With control input S2 tied to logic 0 the four available functions controlled by S1, S0 and 00-output all zeros, O1-subtract B-A, 10-subtract A-B, and 11-add. By selectively using these controls and transferring data over RBIN bus 100 the X fraction register 134 and X accumulator register 136 can be initialized with any desired data values under the control of the raster data processor 110. For example, accumulator register 136 can be cleared using the all zeros output state of adder/subtractor 138 and then any value can be passed through bus 100 to the X fraction register, added to zero and stored in the accumulator register 136. After initializing the X accumulator 136, any desired value can be loaded into the X fraction register 134 from RBIN bus 100. Pixel counter 140 can be directly set with data from bus RBIN 11-0 100.

The binary point is deemed to lie between the most significant bit position of accumulator register 136 and the least significant position of X pixel counter 140. Thus, during operation, X pixel counter 140 stores integer X address values while X accumulator 136 stores fractional X address values. The two most significant fractional address bits, designated $X_1$ and $X_0$ are communicated to frame buffer 16 for use in subpixel addressing the individual pixels of the displayed image.

A set of logic gates 141–143 receives control signals clear accumulators (CLRACCS/) and load X accumulator (LDXACC/), decoded from the RB control signals; and signals delta X sign, (DELXSIGN), and DVG run (DVGRUN/) to control the operation of the X DVG 118. Signal DELXSIGN is generated by RDP 110 as the sign of the difference between X dimension ending and starting points for a vector to be generated. The sign of the difference is output to DVG control circuit 114 as a control signal RBDXSIGN which is latched to generate signal DELXSIGN. The signals L (logic 0) for a plus sign (add) and H (logic 1) for a negative sign (subtract). Signal DVGRUN/ is generated by DVG control circuit 114 in response to a control signal STARTDVG that is decoded from signals received from the RDP 110 over bus RBIN 100 and continues until a pixel counter 148 within DVG CTRL circuit 114 indicates that all points of a vector have been generated. The S0 input to adder/subtractor 138 is generated at Signal XS0=CLRACCS/ (LCXACC+DELXSIGN/). Signal XS0 is thus forced low to produce its zero output for clearing accumulator register 136 by signal CLRACCS/. Subsequently signal LDXACC may be asserted to place adder/subtractor 138 in the add mode so that the contents of the previously loaded fraction register 134 can be added to zero and transferred to accumulator register 136. Signal DELXSIGN is a direction signal. When L (positive sign) adder/subtractor 138 is placed in an add mode and counter 140 counts up. When H (negative sign) adder/subtractor 138 is placed in a subtract mode and counter 140 counts down.

The Y DVG 119 is identical to X DVG 118 except that it is controlled by Y dimension control signals corresponding to the X dimension control signals. The Z DVG 120 is similar to the X and Y DVGs 118, 119 with some small variations. (See FIG. 5).

Figure 5:
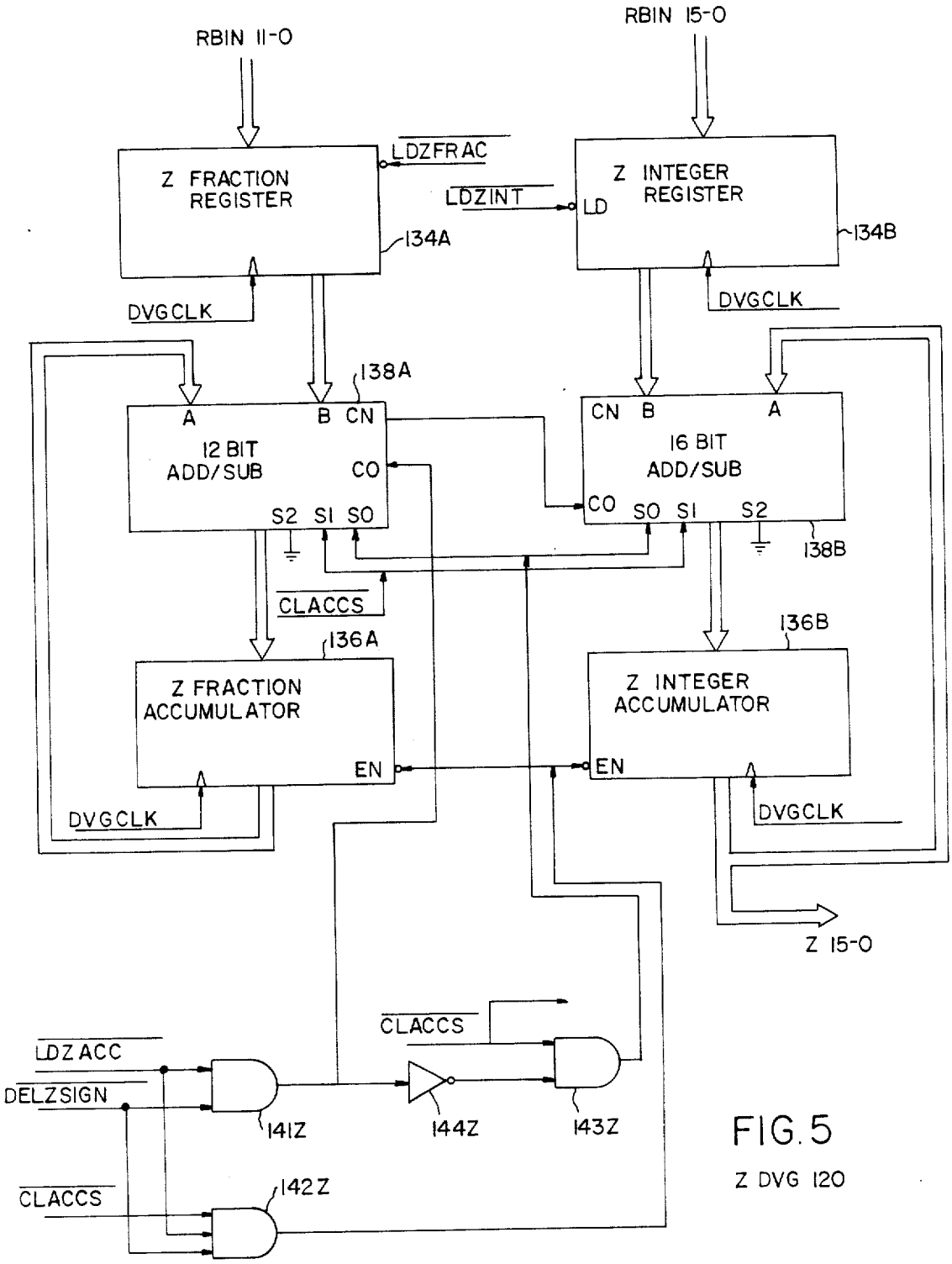
FIG. 5 is a block diagram representation of a single Z dimension digital vector generator used in the digital vector generation subsystem shown in FIG. 3.

Referring now to FIG. 5, Z DVG 120 includes a Z fraction register 134A, a Z integer register 134B, a Z 12 bit fraction adder/subtractor 138A, a Z 16 bit integer adder/subtractor 138B, a Z 12 bit fraction accumulator 136A, a Z 16 bit integer accumulator 142 to 144. The operation of a Z DVG 120 is essentially the same as X and Y DVGs 118, 119 except that the arithmetic capability is expanded to 16 integer bits. This increases the resolution in the Z dimension to 16 integer bits and permits stepping by multiple integer distances in the Z dimension as the digital vector generator system is operated to create video data pixel representations of vectors.

Z integer register 134B may be loaded for initialization from bus RBIN under control of decoded control signal LDZINT/ while Z fraction register 134A may be loaded from bus RBIN in response to decoded control signal LDZFRAC/.

The DVG Z circuit 120 which is shown in FIG. 5, is not constructed with the overflow adder-counter configuration shown for DVDG X circuit 118 in FIG. 4. In order to better resolve small angles and distances in the Z dimension, DVG Z 120 has been provided with a 12 bit fraction portion and a 16 bit integer portion. The fraction portion includes a Z fraction register 134A, a Z adder/subtractor 138A and Z fraction accumulator 136A. The 16 bit integer portion operates synchronously with the fraction portion to process the more significant bit positions and includes Z integer register 134B coupled to receive initializing data from bus RBIN 15-0, an integer accumulator 136B and an integer adder/subtractor 138B. The 16 available integer bits can be scaled by a the user in a known manner so as best to represent the range of Z dimension distances for any given application.

While the selection of initializing data varies somewhat with the particular mode of operation for the vector generator system 126, the mechanics of the operation of each of the digital vector generators 118–123 always remains essentially the same. Using X DVG 118 as the specific example, the integer portion of the starting vector coordinate for each DVG 118–123 is loaded into the integer counter or register 140 from data memory 106 over bus RBIN 100. The fraction register 134 for each DVG is similarly loaded. Then the accumulator registers 136 are cleared by asserting signal CLRACCS/ to force a zero output from adder/subtractors 138 while clock signal DVGCLK is asserted. Next, the load accumulator signals (LDXACC/) go active low to add zero to the starting vector coordinate and store the sum in the accumulator register 136.

For the digital vector generators assigned to the minor spatial axes (X, Y or Z) a roundoff value of $\frac{1}{8}$ (binary 0.001) is then loaded into the fraction register and subsequently added to the fractional starting coordinate value for the initial pixel stored by the accumulator. This $\frac{1}{8}$ pixel value creates an offset which automatically rounds the $\frac{1}{4}$ pixel resolution represented by the two most significant bits to the nearest $\frac{1}{4}$ pixel value. That is, as soon as the accumulated incremental value in the accumulator passes the $\frac{1}{8}$ point, the two most significant accumulator bits will indicate a value of $\frac{1}{4}$ and continue to indicate $\frac{1}{4}$ until the accumulated actual values pass the $\frac{3}{8}$ point at which time the two most significant bits will indicate a value of $\frac{1}{2}$. Rounding is thus automatically effected to the nearest $\frac{1}{4}$ pixel value.

Next, the slope of the vector with respect to the X or Y major axis is loaded into the fraction register 134. The major axis is the X or Y axis to which the vector being displayed is most nearly parallel. This is, the axis to which the angle between the axis and vector is less than or equal to 45°. If the vector lies at exactly 45°, the X axis is treated as the major axis.

For the DVG corresponding to the major axis a delta value of all 1's ($1\text{-}2^{-12}$) is loaded into the corresponding fraction register. If DELSIGN is L (increment accumulator), a carry bit is entered into adder/subtractor 138. If DELSIGN is H (decrement accumulator), a borrow (L) bit is entered into the adder/subtractor 138. This process sets the increment along the major axis to unity.

After the DVGs are stepped to generate a next point, the resultant values are written into the frame buffer 16. The value stored in the fraction register of each DVG is thus added to the corresponding accumulator 136 for each DVG to enable the correct value for each axis to be indicated at the DVG output as the system steps along a line vector in one pixel increments. As the adder/subtractor 138 overflows, the counter 140 is incremented (or decremented) so that for each DVG 118–119 the counter 140 indicates the integer portion of the pixel address and the accumulator 136 indicates the fractional portion. Each DVG 118–123 includes an adder/subtractor 138A, 138B and an accumulator 136A, 136B which extends to the integer portion of the resultant vector coordinate.

Figure 6:
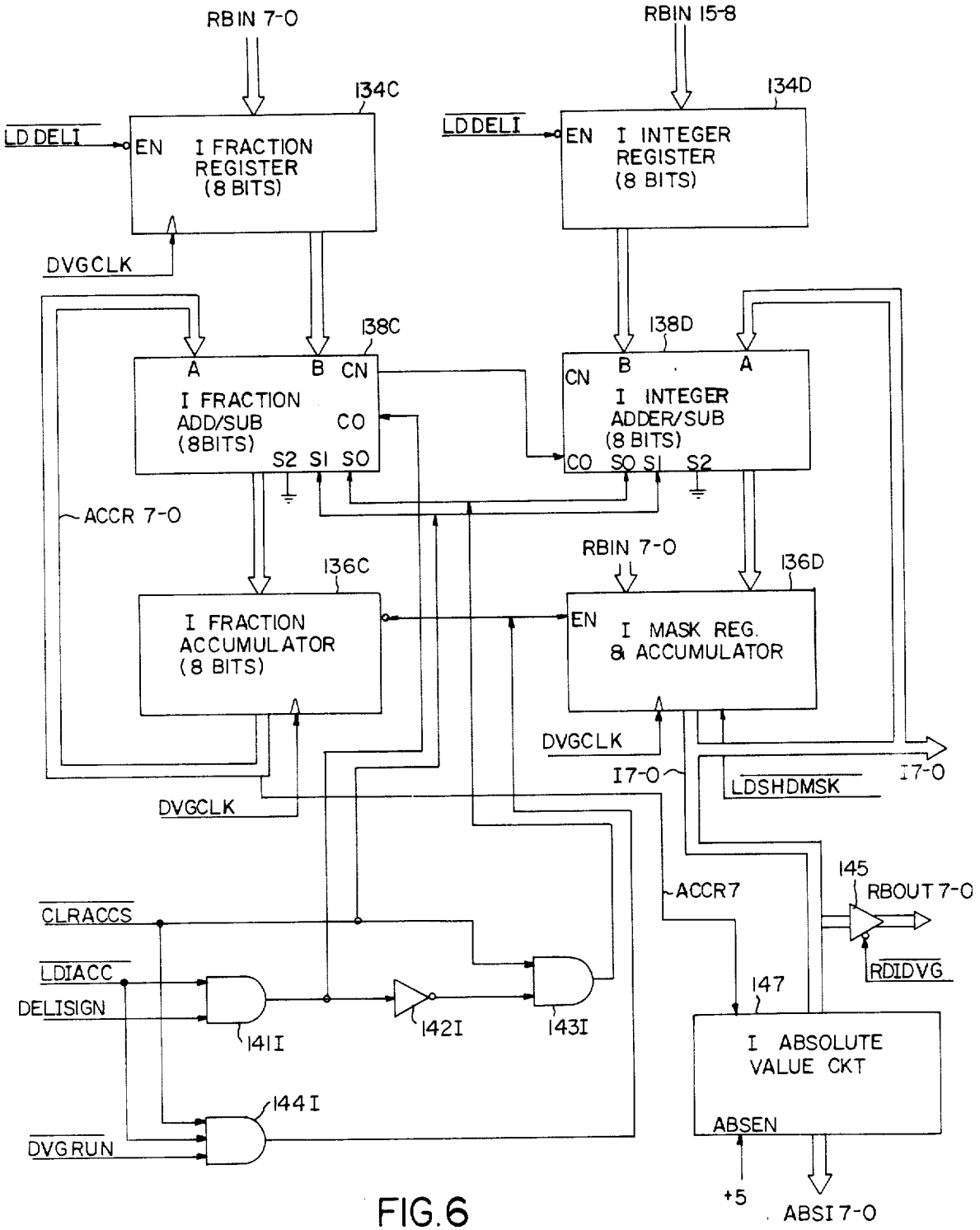
FIG. 6 is a block diagram representation of a single I dimension intensity digital vector generator used in the digital vector generator subsystem shown in FIG. 3.

Referring now to FIG. 6, the dynamic value DVGs I, J, K 121–123 operate in the same general manner as the spatial DVGs 118–120, but have a somewhat more flexible hardware configuration.

DVG I, J. and K 121–123 are similar to DVG X, Y and Z 118–120 except that DVG I, J and K 121–123 operate upon three dimensional normal intensity vectors rather than positional vectors.

The dynamic value DVGs I, J, K 121–123 develop information which defines the visual manifestation characteristics corresponding to the pixels whose addresses are being concurrently generated by the X, Y Z spatial DVGs 118–120. As illustrated by DVG I 121 shown in FIG. 6, the hardware of the dynamic value DVGs provides more flexibility in the selection of operating modes than the spatial DVGs but the basic principle of operation is essentially the same.

A 8 bit I fraction register 134C, an 8 bit I fraction adder/subtractor 138C and an 8 bit I fraction accumulator 136C operate in substantially the same manner as the fraction portion of the X and Y DVGs 118, 119 except that the resolution is decreased from 12 to 8 bits. For each step of the DVGs 118–123, a delta value stored by fraction register 134C is added to an accumulated value stored by I fraction accumulator 136C. However, whereas pixel spatial addresses are determined by pixel locations in a predetermined pixel display array and can at most change by a value of one, the visual characteristics depend on subject lighting conditions and can change by values greater than one at each step. The integer portion of DVG I 121 is thus implemented with an 8 bit I integer register 134D, an 8 bit I integer adder/subtractor 138D and an 8 bit I mask register and accumulator 136D which performs the corresponding accumulator function of I fraction accumulator 136C. I DVG 121 is thus capable of accommodating non-fractional delta increments.

Within the I and J DVGs 121–122, mask register and accumulator 136D enables a selected number of most significant integer bits to be effectively frozen or fixed at a value which can be preset into accumulator 136D while the less significant bits are allowed to accumulate and repetitively overflow as a sequence of pixel definition steps is executed. A mask register within I mask register and accumulator 136D receives and stores a mask control byte from bus RBIN 7-0 100 in response to a decoded register load signal LDSHDMSK 1. Each bit of the mask control byte enables the loading of a corresponding bit position in the accumulator register. By disabling the loading of a given accumulator register bit it is "frozen" and no carries can be passed through to higher order bit positions. All values at the masked bit position and above thus remain constant while lower ordered positions are able to increment and overflow as the integer delta value and carries from the fractional portion are added thereto at each DVG step.

This selective bit freezing function is particularly useful in conjunction with DVG I 121 and DVG J 122 when they are coupled through the pattern shape multiplexer 152 to address pattern RAM 156. In this mode of operation, a pattern stored within a selected number of address locations in pattern RAM 156 can be repetitively outputted every $2^n$ pixels in each dimension where n is the number of bits which are allowed to vary within the I and J outputs. By placing the same delta values in the I, J DVGs 121, 122 as the X, Y DVGs 118, 119 respectively, and freezing selected bits in the I, J accumulator registers, a corresponding pattern can be stored in pattern RAM 156 which will be repetitively accessed synchronously with the incrementing of DVGs X and Y (118, 119) to produce a repetitive display pattern.

For example, if the I output corresponds to the X dimension, and 3 bits are allowed to vary while the remaining bits are frozen, the address input to pattern RAM 156 will repeat itself and thus cause the dynamic output thereof to repeat every $2^3=8$ pixels while stepping in the X direction. Similarly, if the DVG J 122 generates the Y dimension pattern output with three pixels allowed to change states, the Y address input to pattern RAM 156 and hence the corresponding pattern output will repeat every $2^3=8$ steps in the Y dimension.

The size and repetition rate of the pattern stored in pattern RAM 156 thus may be controlled by the mask control signals or, alternatively, by changing the incremental values stored in the I and J fraction registers 134C, the relative pattern sizes may be controlled while I and J mask registers 136D continue to control the repetition rate. The more significant bits of the accumulator register 136D may be masked and used as page address inputs to pattern RAM 156 to select one of a plurality of pages, each storing a different texture pattern within pattern RAM 156.

An I absolute value circuit 147 receives the 8 most significant bits from accumulator register 136D as well as the signal most significant fractional bit from fraction accumulator 136C. Sign bit 17 is used as a control bit while the seven least significant integer bits and the most significant fractional bit are outputted as an 8 bit unsigned number. When enabled, I absolute value circuit outputs the signals received if the sign bit is positive (zero) and the one's complement of the bits received if the sign bit is negative (one). For the I and J DVGs the absolute value circuit is permanently enabled. For K DVG 123, the enable input is controlled by a decoded control signal BACKLITE which selectively enables a backlighting effect. During normal operation either the absolute value of K is selected for backlight, or K is set equal to zero.

Referring now to FIG. 3, the output of pattern shape multiplexer 152 is enabled in response to mode control signal PATTERN while select signal PATTSHPSEL from the mode control register determines which intensity signals may be passed to pattern RAM 156 as address inputs. If PATTSHSEL=0, signals I5–I0 and J5–J0 are selected. Otherwise signals I6–I0 and J5–J1 are selected.

Figure 7:
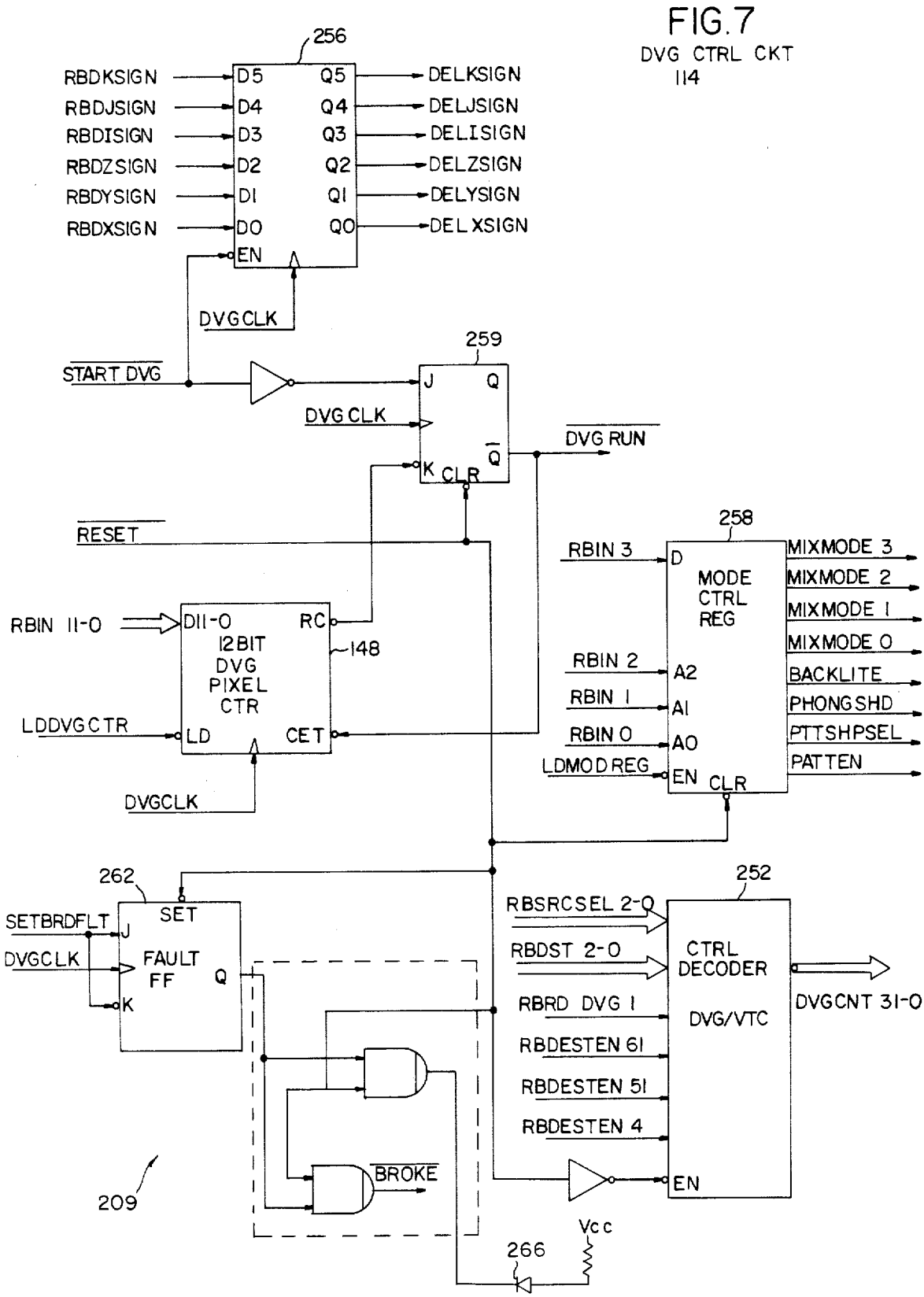
FIG. 7 is a block diagram representation of a DVG control circuit used in the system shown in FIG. 1.

FIG. 7 illustrates the DVG control circuit 114 in somewhat greater detail. DVG control circuit 114 includes the DVG pixel counter 148, the mode control register 258, a control decoder 252, a run control flip-flop 254, and a direction control register 256.

To start the generation of a vector the RDP, 110 initializes the DVG circuits 118–123 as described above, loads the number of pixel points to be plotted into a pixel counter 148 within DVG control circuit 114 (see FIG. 7) under control of a decoded control signal, LDDVGCTR/, and asserts a start signal. STARTDVG/ which is decoded from the DVG control signals by a destination decoder 252.

Signal STARTDVG/ sets DVG run/hold flip-flop 254 which generates at its Q/ output a run signal, DVGRUN/. Signal DVGRUN/ enables operation of each of the DVGs 118–123 as well as a count enable input, CET, of 12 bit DVG pixel counter 250. The digital vector generator system then proceeds automatically to step along a display vector in single pixel increments with respect to the major axis under control of clock signal DVGCLK. After each step a current pixel is written in the frame buffer 16 using the position address and dynamic intensity data developed by the digital vector generators 118–123.

As soon as the vector has been plotted, DVG pixel counter 148 counts down to zero to activate its RC output which operates to reset the run control flip-flop 254 and terminate the run signal DVGRUN/. The digital vector generator system 14 must then be reinitialized with data for the next vector and signal STARTDVG/ must be reasserted to initiate plotting of the next vector.

If a next vector has a first point coincident with an immediately preceding vector, then the first point will already have been output to the frame buffer 16, and the accumulator registers and counters will contain the initial coordinate values. Only the delta or step values and the DVG pixel counter 250 need be updated to generate the next vector.

A direction control register 256 operates in response to signal STARTDVG/ to store 6 direction control signals RBDKSIGN-RBDXSIGN and product signals DELKSIGN-DELXSIGN in response thereto. These signals determine whether the DVG adder/subtractor of each DVG 118–123 operates in an add or a subtract mode. This in turn determines whether for a given dimension, a vector extends in a positive or a negative direction.

A mode control register 258 is implemented as an addressable latch having its data input connected to bus signal RBIN 3 and the three address inputs connected to bus signal RBIN 2-0. Mode control latch 258 is enabled by a decoded control signal LDMODREG/ to store a data input signal in any addressable register location. The eight output control signals may thus be set by RDP circuit 108 to any desired state.

DVG/VTC decoder 252 receives from bus RBIN 100 six control signals RBDEST 0–2, 4–6 which are in essence register address signals. These signals are decoded so long as the reset signal is not asserted to produce twenty-one active low selection signals as follows: LDXYCNTL, SETBRDFLT, LDCLT, LDMODEREG, LDPATT, STARTDVG, CLRACCS, LDDVGCTR, LDSHDMSK, LDKACC, LDDELK, LDJACC, LDDELJ, LDIACC, LDDELI, LDYCTR, LDYACC, LDYFRAC, LDXCTR, LDXACC, LDXFRAC.

A fault flip-flop 262 controls a fault circuit 204 in response to a decoded control signal SETBRDFLT/, to generate a warning signal, BROKE/, and illuminate an LED 266 when DVG system 14 is not properly operating.

It will be appreciated that the contents of the XDVG integer pixel counter 140 and the X accumulator 136 can be concatenated at any given time to provide the complete X dimension pixel address for any current point (see FIG. 4). The integer portion of the address will be in the counter 140 with the 12 bit fractional address portion being in the X accumulator 136. Whenever the addition of the delta value in the X fraction register 134 to the fractional value in the X accumulator 136 results in a sum greater than one, the carry output, CR, of adder/subtractor 138 becomes active high to increment (decrement) the X counter 140 and indicate a next pixel address location. The fractional value stored in X fraction register 134 continues to be added to (subtracted from) the fractional value stored in X accumulator 136. After each DVG update or step the integer portions of the X and Y addresses stored in the X or Y counters are communicated to an address translate and interleave circuit 146 (see FIG. 3) while the two most significant fractional bits for each Y and X are output to the frame buffer memory data bus 116 at DVGDAT 15–12. Address translate and interleave circuit 146 (FIG. 3) then converts the integer X and Y values to memory chip addresses for the frame buffer memory 16. At the X and Y address location indicated by these address values, dynamic intensity video information derived from the contents of the I, J and K digital vector generators 121–123 is stored in the main portion of the frame buffer memory 16 along with the X and Y subpixel values. In addition, the integer and subpixel values of the Z dimension taken from the DVG Z circuit 120 are stored in the Z buffer portion 165a of the buffer memory 16 at the indicated pixel address. If hidden surface processing is activated, then the intensity data is only stored if the Z coordinate value of the pixel is deemed closer to the origin than data previously written into that pixel X, Y location. After the data has been stored in frame buffer memory 16, vector generator circuits 118–123 are incremented. The next sample intensity and subpixel address values are then stored in frame buffer memory 16 at the next pixel address.

In order to determine when the generation of pixel data for a line vector has been completed, the raster data processor 110 (FIG. 3) calculates the number of pixel sample points to be generated and stores this value in the 12 bit DVG pixel counter 148 (FIG. 7). For each occurrence of signal DVGCLK a pixel data point is sampled and stored in the frame buffer memory 16 and the pixel counter 148 is decremented until it reaches a count of 0 at which time an RC output generates a count complete signal which resets run control flip-flop 254 to terminate signal DVGRUN and thus end processing for the current line vector.

Referring now to FIG. 3, a dynamic intensity or visual characteristic processing circuit 150 is coupled to receive visual characteristic information from the visual characteristic vector generators I, J, K 121–123 and process this information to generate information defining the visual characteristics at each spatial pixel point along a display vector that is being generated. Processing circuit 150 includes a pattern shape multiplexer 152 coupled to receive seven bits from the DVG I circuit 121 and 6 bits from the DVG J circuit 122, a normalizing circuit 154 coupled to receive six bits each from the DVI 121 and DVG J 122 circuits and eight bits from DVG K 123, a 4K by 12 pattern RAM 156, and color-/intensity multiplexer 158.

Selected background color patterns, such as dashed line patterns or background color windows for insertion of separate data can be generated by initializing frame buffer 16 to a background color before vector generation begins. A pattern of zero's is then written into pattern RAM 156 at pattern locations at which it is desired that the background color be displayed. Zero detect circuit 166 detects this zero value output data and responds by terminating the active state of signal DVG Write Enable, DVGWE. This prevents the background color stored in frame buffer 16 from being overwritten.

Figure 8:
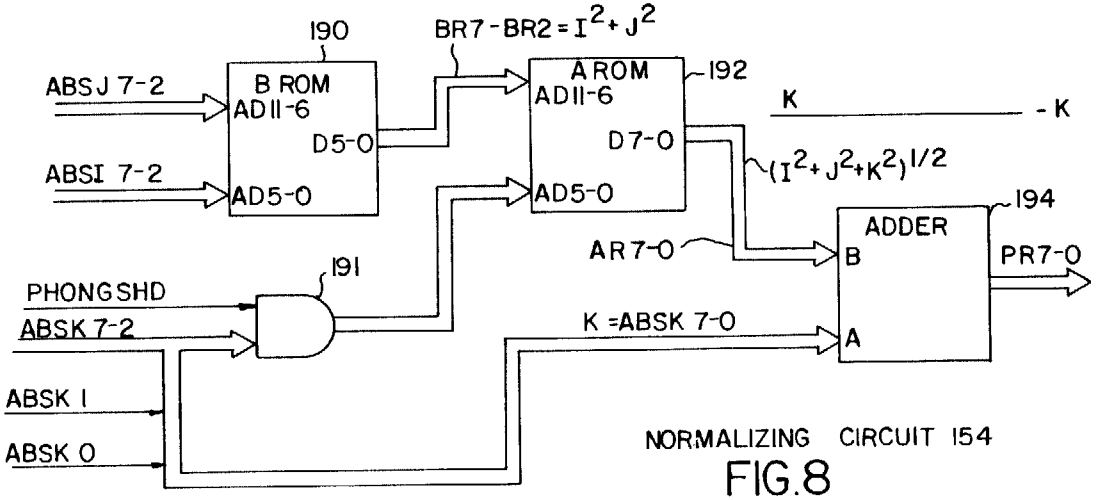
FIG. 8 is a detailed block diagram representation of a normalizing circuit shown more generally in FIG. 3.

Normalizing circuit 154 is shown in greater detail in FIG. 8 and operates during Phong shading operations to convert the three normal magnitudes generated by the I, J and K DVGs 121–123 to a single normalized value that is representative of pixel intensity. During this mode signal PATTEN from mode control register 258 constrains the pattern shape multiplexer 152 to produce a zero address input to texture RAM 156 to assure a constant color output.

Referring now to FIG. 8, normalizing circuit 154 includes a B ROM 190, an A ROM 192 and an adder 194. Adder 194 sums ABSK 7-0 with the AR7-AR0 output from A ROM 192 and outputs PR7-PR0. Normalizing circuit 154 responds to the outputs of the I, J and K digital vector generators 121–123 to approximate the magnitude of a Phong shading algorithm while making optimum use of economically available precision by the formula:

$$N=K/(I^2+J^2+K^2)^{\frac{1}{2}}-K+K \quad (1)$$

N is the corrected intensity component parallel to the K axis. N is computed from the interpolated IJK values. The initial term in parentheses is a correction value to be algebraically added to the interpolated value of K.

Within normalizing circuit 154 all values are treated as unsigned positive fractional values with the decimal point immediately to the left of the most significant bit. B ROM 190 receives the 6 most significant bits of the absolute value output signals from DVG I 121 and DVG J 122 as address inputs and outputs $I^2+J^2$ in response thereto. This output, BR7–BR2, is limited to a maximum value of 0.999 regardless of the input values in order to maintain a combination of a maximum number of significant digits and simple hardware.

A ROM 192 receives as its 6 most significant address inputs 6 data bits D5–0 from B ROM 190 which represent the 6 most significant bits BR7–2 of the B ROM function. A ROM 192 also receives as its 6 least significant address bits the output of an AND gate 191 which receives K intensity signals ABSK7–2 and a single gating signal from mode control register 160, PHONGSHD. A ROM 192 generates the correction term $(K/(I^2+J^2+K^2)^{\frac{1}{2}}-K)$ as output AR7–AR0. Eight bit adder 194 adds the outputs ABSK7–0 and the output of a ROM 192 and as the sum thereof generates output N/, represented by binary signals PR7–PR0.

Figure 9:
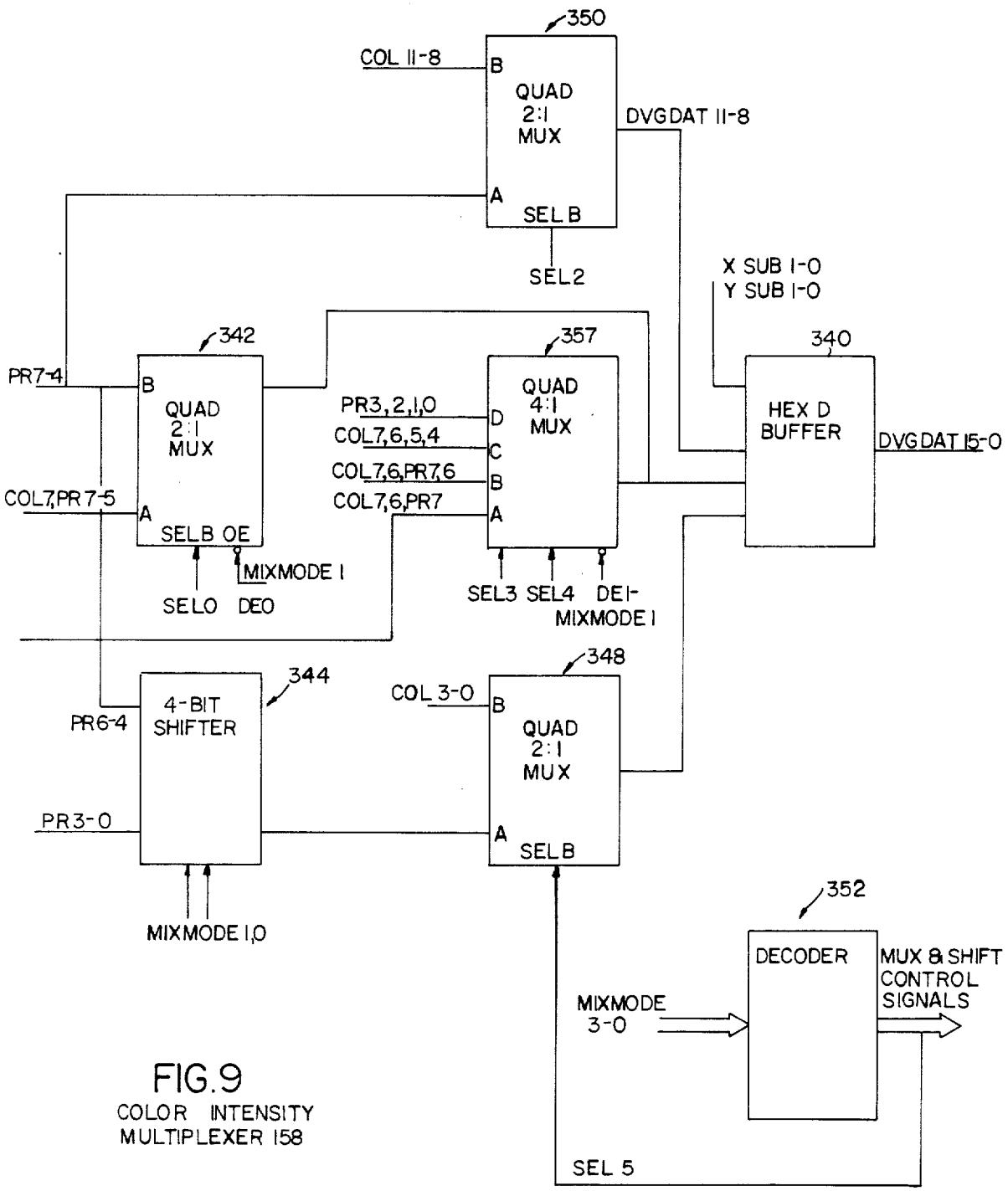
FIG. 9 is a block diagram representation of a color intensity multiplexer used in the digital vector generator subsystem shown in FIG. 3.

Referring now to FIG. 9, color intensity multiplexer 158 receives signals COL 11-0 from pattern RAM 156 and signals PR7–0 from normalizing circuit 154 and selectively combines these signals in one of 6 modes defined by binary counts 0–5 of a mode control signal, MIXMODE 3–0. A buffer 340 receives a selected group of twelve of these signals and outputs them as signals DVGDAT 11–0. Buffer 340 also receives the four X and Y subpixel address signals and outputs them as DVG data signals DVGDAT 15–12 to the frame buffer 16, 16a.

A quad 2:1 multiplexer 350 signals COL 11–8 as a B input and signals PR7–4 as an A input. Multiplexer 350 selects one of these signals as an output in response to a control signal SEL2 and the output signal is connected to buffer 340 to supply bits DVGDAT 11–8.

A decoder 352 receives signals MIXMODE 3–0 and generates the color intensity multiplexer 158 control and selection signals in response thereto. Signal SEL2 is decoded to go low and select the PR7–4 A input only during mode 5. Signal DVGDAT 11–8 thus represents COL 11–8 in modes zero to four and PR7–4 in mode 5.

Signals DVGDAT 7–4 are generated as the output of one of two tri-state multiplexers 342, 357. Multiplexer 357 is a quad 4:1 multiplexer and multiplexer 342 is a quad 2:1 multiplexer. The output enable input to mulitplexer 357 is connected to signal MIXMODE 1 while the output enable input to multiplexer 342 is connected to signal MIXMODE 1/. Multiplexer 342 is thus active during modes 2 and 3 while multiplexer 357 is active during modes 0, 1, 4 and 5.

Decoder 352 generates signal SEL$\phi$ low during mode 2 to provide signals COL 7, PR7–5 for signals DVGDAT 7–4. During the mode 3 signal SEL0 is generated high to select the B input and couple signals PR7-4 to DVGDAT 7-4.

Decoder generates signals SEL 3, 4 to select one of 4 inputs A-D to multiplexer 357 during modes 0, 1, 4 and 5. During mode zero input A is selected to couple COL 7-5, PR7 to DVGDAT 7-4. During mode 1 input B is selected with signals COL 7-6, PR 7-6. During mode 4 input C is selected with signals COL 7-4 and during mode 5 input D is selected to provide signals PR3-0.

The four least significant bits DVGDAT 3-0 are coupled to buffer 340 by a quad 2:1 multiplexer having a B input connected to receive signals COL 3-0 and an A input coupled to the output of a 4 bit shifter 344. The SEL B input to multiplexer 348 is decoded to go high to select the B input and signals COL 3-0 during modes 4 and 5. During modes zero to three signal SEL 5 remains low to select the output of shifter 344.

Shifter 344 receives as inputs signals PR6-0. The shift control inputs to shifter 344 are responsive to signals MIXMODE 1, 0 to output during mode 0, PR6-3, during mode 1, PR5-2, during mode 2, PR4-1 and during mode 3, PR3-0.

The various modes and signal combinations are summarized in Table 3.

TABLE 3

| MIXMODE | DVGDAT 11-8 | DVGDAT 7-4 | DVGDAT 3-0 |
|---|---|---|---|
| 0000 | COL 11-8 | COL 7-5,PR7 | PR6-3 |
| 0001 | COL 11-8 | COL 7-6,PR7-6 | PR5-2 |
| 0010 | COL 11-8 | COL 7, PR7-5 | PR4-1 |
| 0011 | COL 11-8 | PR7-4 | PR3-0 |
| 0100 | COL 11-8 | COL 7-4 | COL 3-0 |
| 0101 | PR7-4 | PR3-0 | COL 3-0 |

Figure 10:
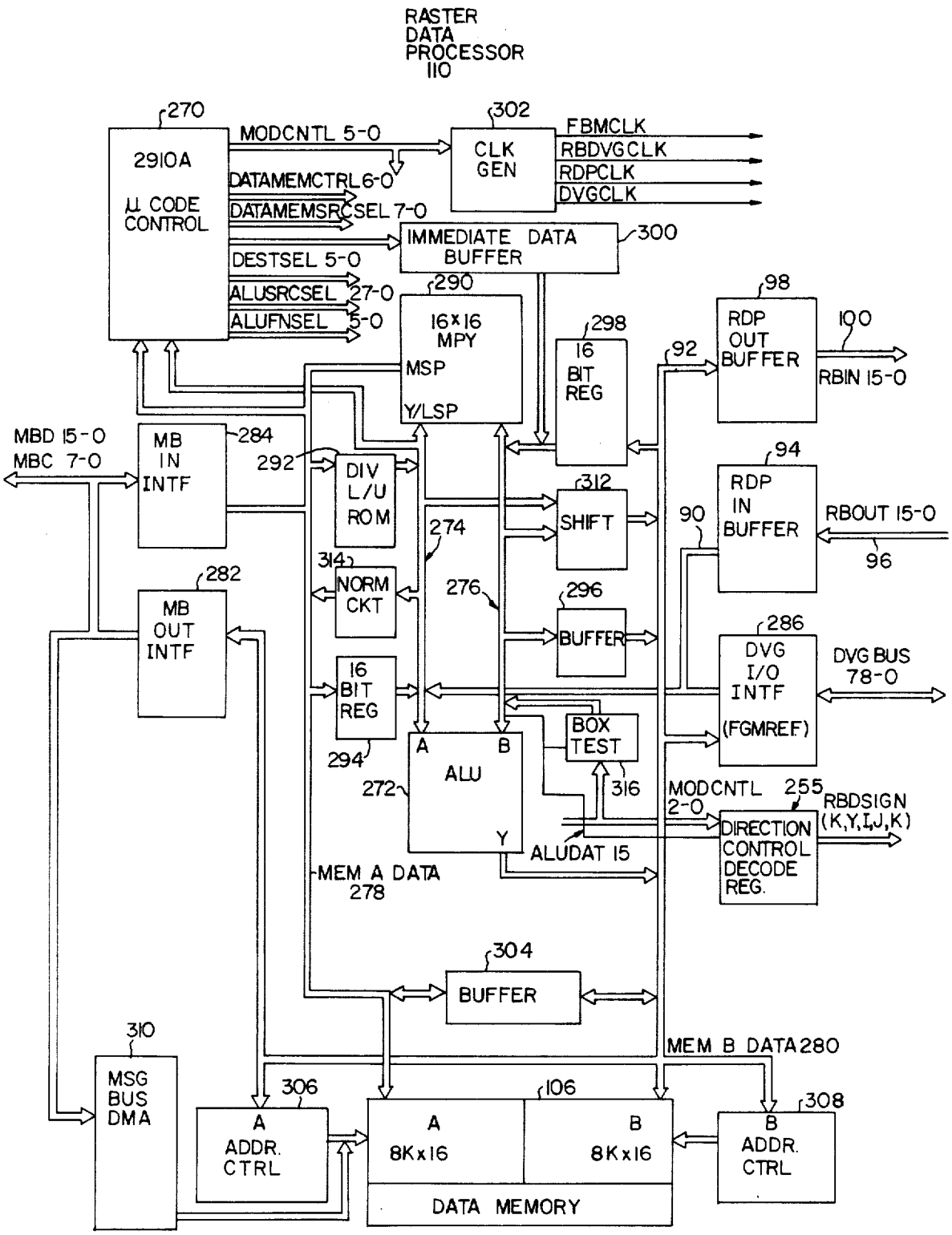
FIG. 10 is a block diagram representation of a raster data processor (RDP) used in the digital vector generator subsystem shown in FIG. 3; and, FIG. 11 is a graphic representation of examples used to illustrate the operation of the invention.

Referring now to FIG. 10, there is shown the raster data processor (RDP) 110 along with data memory 106. Master control for the RDP 110 as well as the digital vector generator system 12 is provided by a 2910 microcode control unit 270 which is arranged in a conventional manner and includes a 2910 controller and a 4K×64 microcode memory with conventional decoding. Microcode control 270 provides six mode control signals MODCNTL 5-0 which are used to control several different functional circuits throughout the digital vector generator system 12. The signals are communicated in a manner analogous to a data bus. For example, during execution of a clock generator initialize routine a selected set of clock speed control signals is placed on the MODCNTL lines and loaded into a clock generator control register. In a similar manner an RDP mode register, a box test control register, a shift control register and a multiplier control register can all be sequentially loaded to provide selectable control by RDP 110. Most of these mode control registers are used in a conventional manner and have not been explicitly shown in the drawings.

Direction control register 256 (FIG. 7) is an example of such a control register. In this case following a computation within RDP 110, the three least significant bits MODCNTL 2-0, are used as bit selection addresses to load the ALU 272 (FIG. 10) output sign bit, ALUDAT 15, into a selected bit position of a direction control decode register 255. Each bit position generates an output driving one of the RBDSIGN control signals which are in turn stored by direction control latch 256 (FIG. 7).

Microcode control 270 also outputs a set of source select signals, DATAMEMSRCSEL 7-0 and a set of destination select signals DEST 5-0. These signals generate RBSRCSEL 2-0, RBDST 2-0 and RBDESTEN 6-4 which are decoded by control decoder 252 (FIG. 7) to generate the source and destination select signals for the pixel data generator 112. These signals are typically used during a bus transfer to designate the register or memory which is to be enabled to place data onto the bus as well as the destination register or memory which is to be strobed to take data off of the bus. By applying the 6 destination signals in a two step sequence, first to select one of a plurality of decoders and then to supply a code to be decoded by the selected decoder, more than 64 destination select signals can be generated from signals DEST 5-0.

Other control signals include ALU functions select 5-0 (ALUFNSEL 5-0) which control the function performed by an arithmetic logic unit 272, signals ALU source select 27-0 (ALUSRCSEL 27-0) which control the sources of data for A and B ALU data buses 274, 276, signals data memory source select 7-0 (DATAMEMSECSEL 7-0) which define the source of data applied to the input of the A and B portions of data memory 106, and signals data memory control 6-0 (DATAMEMCTRL 6-0) which control the operation of data memory 106.

In addition to the A and B ALU data buses 274, 276 the RDP 110 main bus structure includes a memory A data bus 278 connected to the input/output port of the A portion of data memory 106 and a MEM B data bus 280 connected to the input/output port of the B portion of data memory 106.

A message bus output interface circuit 282 provides an output coupling between the memory B data bus 280 and a message bus which connects digital vector generator system 14 to the image generation and storage system 12. A memory buffer input interface circuit 284 provides an input connection between the meassage bus and the memory A data bus 278. The message bus includes 15 data lines designated MBD 15-0 and 8 control lines designated MBC 7-0. The A ALU data bus 274 connects through the RDP output data bus 90 to RDP input buffer 94 to provide a connection to bus RB OUT 15-0 96 which services the pixel data portion 112 of digital vector generator 14. In a similar manner, the MEM B data bus 280 connects through RDP input data bus 92 to RDP output buffer 98 which provides connection to RB IN 15-0 bus 100 for the pixel data generating portion 112 of digital vector generator system 14. A digital vector generator input/output interface 286, which includes refresh control for the frame buffer memory 16, is coupled to transfer data from a digital vector generator bus DVGBUS 78-0 to the A ALU data bus 274 and to transfer data from the MEM B data bus 280 to DVGBUS 78-0. DVGBUS 78-0 includes a data portion DVGDAT 15-0 which connects to the output of color/intensity mixer 158 as well as to frame buffer memory 16 and an address portion DVGADDR 15-0 which connects to the output of address translate and interleave circuit 146 as well as to frame buffer memory 16. Data for Z buffer 16a, subpixel addressing and two overlay stores within frame buffer 16 are carried by data lines DVGDAT 33-16.

An arithmetic logic unit 272 has its A input connected to the A ALU data bus 274, its B input connected to the B ALU data bus 276 and its Y output connected to the MEM B data bus 280. A 16×16 multiply circuit 290 has its Y input and least significant product output connected to the A ALU data bus 274, its X input connected to the B ALU data bus 276 and a most significant product output connected to the MEM A data bus 278. Together, the multiplier 290 and ALU 272 provide the programmed ALU control circuit 108 with a sophisticated, high speed arithmetic capability for rapid manipulation and transfer of vector data. A divide lookup ROM 292 provides a high speed division capability and has its address input connected to MEM A data bus 278 with its outputs connected to the A ALU data bus 274. A 16 bit data register 294 provides a connection between the MEM A data bus 278 and the A ALU data bus 274. Similarly, a buffer 296 provides a connection from the B ALU data bus 276 to the MEM B data bus 280. A 16 bit register 298 provides a data connection in the opposite direction from the MEM B data bus 280 to the B ALU data bus 272. An immediate data buffer 300 provides a connection for 16 bits of data from the 2910 microcontrol 270 to the B ALU data bus 272 to enable the microcode control 270 to directly place data onto the B ALU data bus 276. A clock generator 302 receives mode control signals MODCNTL 5-0 from the microcode control circuit 270 and in response thereto generates the master system control clock signals, frame buffer memory clock, FBMCLK, digital vector generator clock, DVGCLK, and raster data processor clock RDPCLK. A buffer 304 provides bidirectional communication directly between the MEM A data bus 278 and the MEM B data bus 280.

An A address control circuit 306 receives address data from MEM B data bus 280 and in response thereto generates the address signals for addressing the A portion of data memory 106. Similarly, the B address control circuit 308 receives address in information from MEM B data bus 280 and in response thereto provides address signals for accessing the B portion of data memory 106. A message bus DMA circuit 310 is coupled through control signals not explicitly shown to microcode controller 270 and to the address output of A address control circuit 306 to provide for direct memory access data transfers from the message bus to RDP 110 in a conventional manner.

A shift circuit 312 has inputs connected to A ALU bus 274 and B ALU bus 276 and an output connected to the 16 bit MEM B data bus 280. Shift circuit 312 in effect concatenates the 16 bit A ALU bus signals 274 as the most significant word and the 16 bit B ALU bus signals on bus 276 as the least significant word and shifts a selected group of 16 of these signals to the ouput in response to a 4 bit shift command SHFNUM 3-0 when enabled by an enable shift signal, ENSHIFT/. If SHFNUM 3-0 equal 0, the contents of A ALU bus 274 are shifted through to the memory B data bus 280. Each increase in the shift control number represented by signal SHFNUM 3-0 in effect shifts the concatenated bus signals left by one position up to a maximum of 15 at which point signal ALU A 0 from the A ALU bus 274 is output in the most significant bit position and signals ALU B 15-1 are output in the less significant bit positions. Shift circuit 312 thus provides a mechanism for converting independent signals on the A and B ALU buses 274, 276 to a selected group of a concatenated combination thereof.

A normalizing circuit 314 facilitates hardward adjustment of the binary point as a means of improving operating speed. It detects the number of leading zero's in a signal on ALU A bus 274 and generates shift control signals SHFNUM 3-0 in response thereto. These shift control signals are communicated to shift circuit 312 and may also be coupled onto MEM A data bus 278.

A box test circuit 316 receives the most significant ALU output data bit, ALUDAT 15, which is the output sign bit as well as mode control signals MODCNTL 2-0 and enable signals and operates to determine whether or not a set of values is within a certain range. It is particularly useful in determining very rapidly whether or not a vector is within a selected spatial volume.

Below are described several examples that clarify the execution of the invention.

EXAMPLE 1

Figure 11:
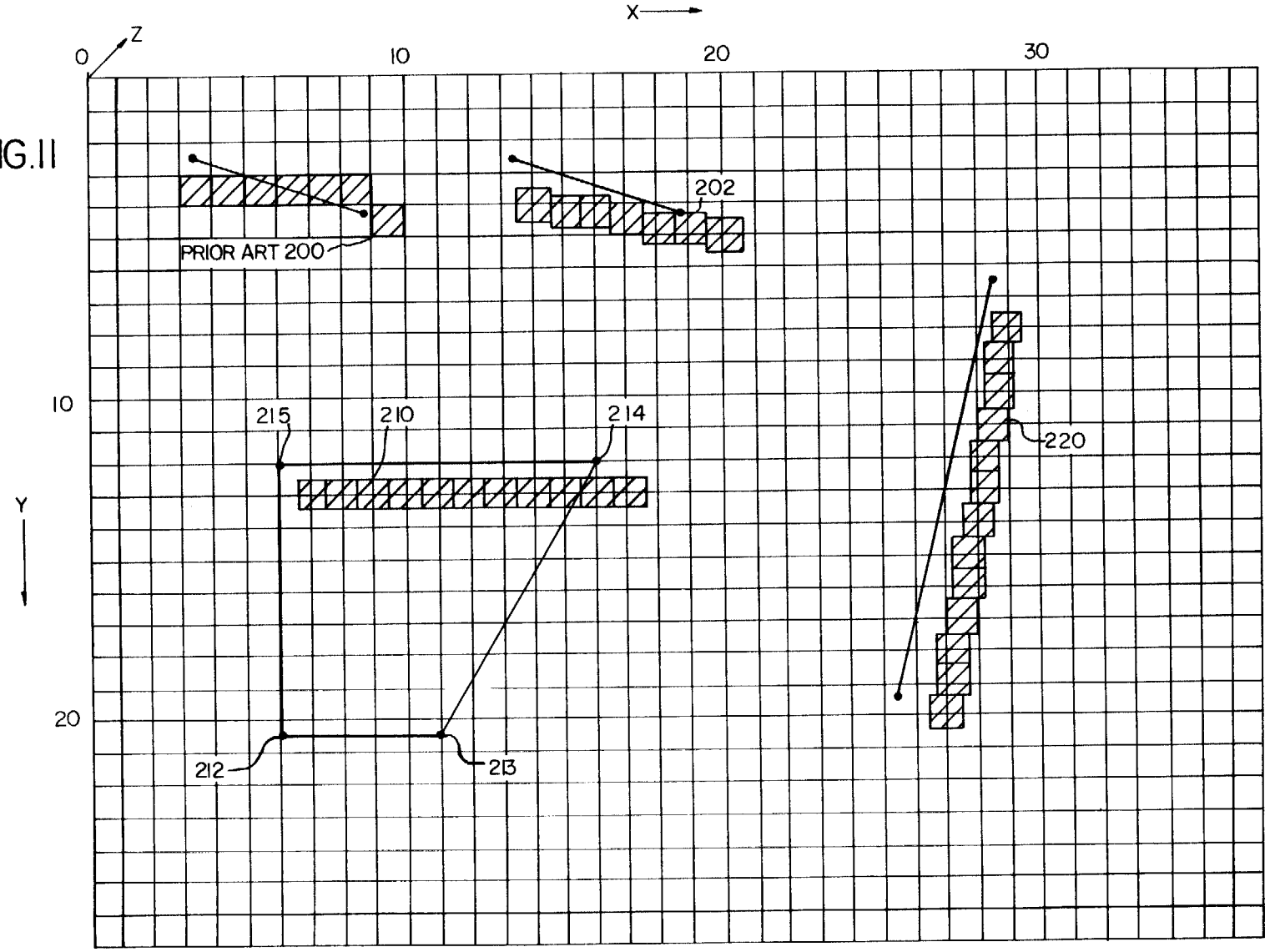

PRIOR ART—Conventional integer pixel addressing. Consider the line vector 200 shown in FIG. 11 in an X, Y, Z Cartesian coordinate grid representing the face 24 of CRT 22. Line vector 200 has a start point (3.40, 2.75, 1) and an end point of (8.85, 4.22, 1). An integer X value is deemed to define the left boundary of a column of base or background pixel positions while an integer Y value is deemed to define a lower boundary of a row of base or background pixel positions. In other words, each pixel is identified by the location of the upper lefthand corner thereof in FIG. 11.

RDP 110 first rounds off the start and end points to (3,3,1) and (9,4,1), and then initializes the DVGs as follows. By comparing the differences between rounded-off X and Y coordinates, X is determined to be the major axis because delta X is greater than delta Y. Then the distance $9-3=6$ along the X axis is calculated and stored in pixel counter 148 (see FIG. 7). X counter 140 (see FIG. 4) is initialized at 3, X accumulator 136 is initialized at 0.000 and X fraction register is initialized at 0.999. Since DVGXMAJOR is active, the carry into adder/subtractor 138 is activated, and the X DVG steps in increments of unity.

Delta X is calculated as $\Delta X=9.00-3=6$ and $\Delta Y$ is calculated as $4.00-3.00=1.00$. The initial fractional Y value (0.000) is then stored in the Y accumulator and the slope delta Y/delta $X=0.167$ is stored in the Y fraction register. The initial integer number Y pixel value of 3 is stored in the Y counter.

Similarly, the initial integer Z value (1) is stored in the Z integer accumulator 136B, the initial fractional Z value (0) is stored in the Z fraction accumulator 136A and the Z slope $Z/X=0$ is stored in the Z fraction register 134A and Z integer register 134B. This 0 slope value will preclude incrementing of the Z counter and cause a Z value of 1 to be output at each pixel location along the line 170.

Table 4 below lists the values that are generated as DVGs X, Y, Z 118-120 are stepped along line vector 200. The fractional values contained in the accumulators are not used in establishing the pixel locations but are included for ease of reference. It can be seen from Table 4, that the value of Y stays at 3, and then jumps to 4 at the end point of the vector. As the counter 250 counts down to zero the operation is complete and the system is ready to reinitialize for generation of the next line vector.

TABLE 4

| X | Y | Z | CTR |
|---|---|---|---|
| 3.000 | 3.000 | 1.000 | 6 |
| 4.000 | 3.167 | 1.000 | 5 |
| 5.000 | 3.334 | 1.000 | 4 |
| 6.000 | 3.501 | 1.000 | 3 |
| 7.000 | 3.668 | 1.000 | 2 |
| 8.000 | 3.855 | 1.000 | 1 |

TABLE 4-continued

| X | Y | Z | CTR |
|---|---|---|---|
| 9.000 | 4.002 | 1.000 | 0 |

EXAMPLE 2

Subpixel addressing in accordance with the invention. Consider a line vector 202 which is similar to line vector 200 except that it is translated by 10 pixel locations along the X axis. Line vector 202 extends from (13.40, 2.75,1) to (18.85, 4.22,1). At a quarter pixel resolution these points become (13.50, 2.75,1) and (18.75, 4.25,1). The RDP 110 calculates these initial point pixel values along with the visual characteristic values (shading in this example) and stores then in the DVGs 118–123.

The actual display coordinates for the line end points are determined by rounding-off the end points to the nearest integer pixel location in the display. Then $0.625=\frac{1}{2}+\frac{1}{8}$ is added to the rounded-off integer values. The $\frac{1}{2}$ component of this value assigns the background subpixel address value of 2 quarters to the end points while the 150 component enables the fractional values to be rounded to the nearest quarter pixel by simply truncating the less significant fractional address bits. Assignment of line vector end points to integer pixel locations with 2,2 subpixel address values assures proper matching of mating line segments with no visual discontinuities.

In the present example the rounded-off end points are determined as:

X initial = INT(13.40+0.5)=13
Y initial = INT(2.75+0.5)=3
Z initial = 1.0
K initial = INT(27+0.5)=27
X final = INT(18.85+0.5)=19
Y final = INT(4.22+0.5)=4
Z final = 1.0
K final = INT(17+0.5)=17

Note that Z dimension values retain their exact integer and fractional values.

The difference values are then calculated from the end point display locations as:

Delta X = 19−13=6
Delta Y = 4−3=1
Delta Z = 1.0−1.0=0

Delta X is clearly the larger value so the X axis is selected as the major spatial axis.

Let it be further assumed that Gouraud shading is to be used in this example with the intensity at the initial point being 29 and the intensity at the final point being 17. For this shading mode DVG K 123, is used to generate the visual intensity values and with signal PHONGSHD at logic zero AND gate 191 of normalizing circuit 154 (FIG. 8) is disabled so that zero is presented to the B input of adder 194 and the output is simply PR7–0 equals ABSK 7–0. Pattern shape multiplexer 152 is disabled by signal PATTEN=0 so that address zero is presented to pattern RAM 156. Any desired hue may be stored at this location. Color intensity multiplexer 158 is preferably set to mode 5 so that the 12 bits of visual characteristic information stored in frame buffer 16 comprise PR7–0 col. 11–8. For Gouraud shading a linear interpolation is made between the starting and ending intensity values of the vector being generated. It is determined that Delta K=17−29=−12. Delta X remains 6.0 and the color intensity slope Delta K/Delta X=−2.00.

An initialization pixel counter 148 is set to the major axis (X) delta value of 6. The initial display X location is written into DVG X 118 with 13 being written into counter 140 and 0.625 being written into accumulator 136. Since X is the major axis, a delta value of 0.999 is written into the fraction register 134. DVG Y 119 is initialized with 3 being written into the counter and 0.625 being written into the accumulator register, and Delta Y/Delta X=1/6=0.1667 being written into the fraction register. DVG Z is initialized at 1 with a fraction value of zero which maintains the indicated value constant at one. The K accumulator is initialized with the rounded-off actual K value=29. The K fraction register is initialized with the color intensity slope of −2.0.

The successive values generated by vector generator subsystem 126 are illustrated in Table 5 with the initial values shown in step 1.

At step 7 pixel counter 148 decrements to zero to signal the end of processing for the current line vector. Looking at the vector 202 in FIG. 11, it can be seen that the subpixel addressing representation of vector 202 is much less jagged than the integer pixel addressing representation of corresponding line vector 200.

Throughout the vector processing operation address zero is applied to pattern RAM 156 so that the four most significant bits of color stored at word location zero drive color bits C11–C8 while the eight absolute value bits from DVG K 123, K7–K0 drive frame buffer memory bus DVGDAT 11–4. The resultant effect is a constant hue with a varying intensity. The X and Y quarter pixel values are of course placed on frame buffer memory bus 116 conductors DVGDAT 15–12 as the visual characteristic data for each pixel point is stored.

TABLE 5

| STEP | X | Y | K | CTR |
|---|---|---|---|---|
| 1. | 13.625 | 3.625 | 29 | 6 |
| 2. | 14.625 | 3.792 | 27 | 5 |
| 3. | 15.625 | 3.958 | 25 | 4 |
| 4. | 16.625 | 4.125 | 23 | 3 |
| 5. | 17.625 | 4.292 | 21 | 2 |
| 6. | 18.625 | 4.458 | 19 | 1 |
| 7. | 19.625 | 4.625 | 17 | 0 |

EXAMPLE 3

A polygon 210 is to be displayed and filled with a pattern as shown in Table 6 in accordance with the invention.

TABLE 6

| | 0 | 1 | 2 | 3 | 4 | 5 | 6 | 7 |
|---|---|---|---|---|---|---|---|---|
| 0 | 0 | 0 | 0 | 1 | 1 | 0 | 0 | 0 |
| 1 | 0 | 0 | 0 | 1 | 1 | 0 | 0 | 0 |
| 2 | 0 | 0 | 0 | 1 | 1 | 0 | 0 | 0 |
| 3 | 1 | 1 | 1 | 1 | 1 | 1 | 1 | 1 |
| 4 | 1 | 1 | 1 | 1 | 1 | 1 | 1 | 1 |
| 5 | 0 | 0 | 0 | 1 | 1 | 0 | 0 | 0 |
| 6 | 0 | 0 | 0 | 1 | 1 | 0 | 0 | 0 |
| 7 | 0 | 0 | 0 | 1 | 1 | 0 | 0 | 0 |

The pattern shown in Table 6 begins at display coordinates 0,0 and repeats vertically and horizontally every 8 pixels with 0 representing a selected first color and 1 representing a selected second color different from the first color. The signal PATTSHPSEL will be set to 1 so that pattern shape multiplexer 152 supplies the 12 address inputs to pattern RAM 156 as 15–0, J5–0. Only bits I2–0 and J2–0 are used to control pattern RAM 156. Bits I5–I3 and J5–J3 are set and masked in the I and J DVGs 122 and 123. In addressing the pattern RAM, I and J determine the spatial frequency and phase of the data generated by the pattern RAM, 156.

To allow different patterns to be retained in different locations within texture RAM 156 the current pattern will be stored in texture RAM 156 starting at address 3640 (H E38). This address corresponds to setting the masked bits I5–I3 and J5–J3 equal to logic ones. The top or Y=0 row of the pattern is written into the eight sequential word locations beginning at address 3640 (H E38). The background color corresponding to "0" in the pattern is written into word locations 3640–42 (H E38–E3A) and 3645–47 (H E3D–E3F) while the foreground color corresponding to "1" in the pattern is written into address word locations 3643–4 (H E3B–E3C). The next 63 memory address word locations are skipped and row Y=1 is written starting at word address 3704 (H E78). Row Y=2 is written starting at address 3768 (H EB8) and the process continues until the top, Y=7, row is written starting at word address 4088 (H FF8).

It will be assumed that color intensity multiplexer 158 is set to mode 1 so that the 12 bit visual characteristic words stored in the frame buffer 16 are derived as COL 11–6, PR 7–2.

Gouraud shading will be employed, and the initial values for the polygon 210 are set forth in Table 7 as defined for the four corner points 212, 213, 214 and 215. The Table 7 information is given as source data or calculated by RDP 110 with the vertex display locations indicated in parentheses.

TABLE 7

| Point | X | Y | Z | I | J | K |
|---|---|---|---|---|---|---|
| 212 | 6.0 | 20.4 | 1 | 8 | 8 | 75 |
| 213 | 10.9 | 20.4 | 1 | 13 | 8 | 115 |
| 214 | 16.1 | 12.0 | 1 | 18 | 0 | 124 |
| 215 | 6.0 | 12.0 | 1 | 8 | 0 | 94.6 |

X, Y and Z are the spatial coordinates of the vertices of the quadrilateral. I and J define the start and stop locations of data to be selected from the pattern RAM. K is the magnitude of the surface normal intensity component pointing at the observer in a direction parallel to the Z axis.

To fill the quadrilateral, the RDP proceeds as follows. First of all the highest vertex is located. If there are two, the leftmost is selected. Next the RDP executes a software DVG function that picks a pair of points with the same ordinate until the next highest vertex is reached. Then the software DVG proceeds to the next lower vertex and finally to the lowest vertex. For both points of each pair, the X, Y, J, Z, I, J and K values are computed by interpolation.

Following the computation of each pair of points, the X DVG, 118 interpolates the pixel data between the points to generate one horizontal fill line. I DVG 121 is stepped synchronously with X DVG to generate the I bits that address the pattern RAM. Thus the quadrilateral is filled with a series of horizontal lines.

Visual Attribute data is stored in frame buffer memory 16 as a function of the IJ data supplied to the pattern RAM 156. In this example, I DVG, 121 is incremented in tandem with the X DVG, 114, and J DVG, 121 is incremented in tandem with Y DVG 119. Table 8 shows the data interpolated to generate the first line.

TABLE 8

| Step | X | Y | Z | I | J | K | Imod8 | Jmod8 | Pat |
|---|---|---|---|---|---|---|---|---|---|
| 1 | 6.625 | 12.625 | 1 | 8 | 0 | 95 | 0 | 0 | 0 |
| 2 | 7.625 | 12.625 | 1 | 9 | 0 | 97.9 | 1 | 0 | 0 |
| 3 | 8.625 | 12.625 | 1 | 10 | 0 | 100.8 | 2 | 0 | 0 |
| 4 | 9.625 | 12.625 | 1 | 11 | 0 | 103.7 | 3 | 0 | 1 |
| 5 | 10.625 | 12.625 | 1 | 12 | 0 | 106.6 | 4 | 0 | 1 |
| 6 | 11.625 | 12.625 | 1 | 13 | 0 | 109.5 | 5 | 0 | 0 |
| 7 | 12.625 | 12.625 | 1 | 14 | 0 | 112.4 | 6 | 0 | 0 |
| 8 | 13.625 | 12.625 | 1 | 15 | 0 | 115.3 | 7 | 0 | 0 |
| 9 | 14.625 | 12.625 | 1 | 16 | 0 | 118.2 | 0 | 0 | 0 |
| 10 | 15.625 | 12.625 | 1 | 17 | 0 | 121.1 | 1 | 0 | 0 |
| 11 | 16.625 | 12.625 | 1 | 18 | 0 | 124.0 | 2 | 0 | 0 |

Data for the second line is generated in a similar fashion with the software interpolated values of X, Y, Z, I, J and K being inserted as the end points of the DVGs. Note that for the second line Z=1 and J=1.

At the termination of the fill procedure it will be apparent that the edges of the quadrilateral are jagged. This is due to the rounding off of the end point subpixel addresses to the (2,2) bias value. To eliminate this effect the boundary of the quadrilateral is redrawn using the X, Y, Z, I, J, K DVGs. Now the subpixel address bias is overwritten with the correct offset.

EXAMPLE 4

A line vector 220 is generated using a combination of subpixel addressing and Phong shading. Let the initial point be represented by X, Y, Z=25.6, 19.4, 4.2 with three normal light vector components determined to be I, J, K=66, 125, 82. Let the final point be represented by X, Y, Z=28.4, 6.5, 1 with the three normal light vector components determined to be I, J, K=116, 88, 45.

Color/intensity multiplexer 158 is set to mode 1 to output 6 bits of color (hue) from texture RAM 156 (COL 11–6) and 6 bits of intensity from normalizing circuit 154 (PR 7–2). Pattern shape multiplexer 152 is disabled by signal PATTERN=0 so that address zero is continuously presented to pattern RAM 156. Color bits COL 11–6 are loaded into the pattern RAM 156 from the RBIN bus. COL 11–6 bits are continuously outputted to color/intensity multiplexer 158.

The individual digital vector generators 119–123 are initialized as shown for step 1 in Table 9. The initial X pixel display location 26.625 is written into X counter 140 and into the X accumulator 136. The X increment value Delta X/(Delta Y)(Y INC.)−2.0/(−12.0)(−1)−0.1667 is placed in the fraction register. The (−1) coefficient in this calculation accounts for the Y counter decrementing.

DVG Y 119 is initialized by placing the initial integer Y value, 19, in the counter and the fractional value of 0.625 in the accumulator. The −0.999 stepping distance is placed in the fraction register.

DVG Z 120 is initialized by placing the initial integer Z value, 4 in the integer accumulator register and the fractional value 0.7 (0.2 plus a roundoff value of 0.500) in the fraction accumulator register. The slope (Delta Z/Delta Y)(Y INC)-(−3.2/−12.0)(−1) - −0.2667 is placed in the Z fraction register. The Z output MUX is set to bypass the Z absolute value generator although no negative Z values will be encountered in this particular example.

DVG I 121 is initialized by placing the initial I vector value, 66 plus 0.500 roundoff, in the accumulator 174 and the slope Delta I/Delta Y-50/(−12.0)(−1)-4.167 in the integer and fraction registers 134D, 134C.

The DVG J 121 is initialized by loading the initial value plus a 0.500 roundoff-125.500 into the accumulator and the slope (Delta J/Delta Y)(INC. Y)-(−37/12.0)(−1)-−3.083 into integer and fraction register.

DVG K 122 is initialized by loading the initial value plus a roundoff value of 0.5=82.500 into the accumulator register and the slope (Delta K/Delta Y)(INC Y)-(−37/12.0)(−1)-−3.083 into the integer and fraction registers of DVG K 122.

The pixel counter 148 is set to an initial value of INT(AABST (Delta Y))-12 to count major axis pixel steps.

The steps encountered by the pixel data generator 112 while generating the line vector 220 pixel information are set forth in Table 9 beginning with initialization at step 1.

TABLE 9

| Step | X | Y | Z | I | J | K | CNTR |
|---|---|---|---|---|---|---|---|
| 1 | 26.625 | 19.625 | 4.700 | 66.500 | 125.500 | 82.500 | 12 |
| 2 | 26.792 | 18.625 | 4.433 | 70.667 | 122.417 | 79.417 | 11 |
| 3 | 26.958 | 17.625 | 4.167 | 74.833 | 119.333 | 76.333 | 10 |
| 4 | 27.125 | 16.625 | 3.900 | 79.000 | 116.250 | 73.250 | 9 |
| 23 5 | 27.292 | 15.625 | 3.633 | 83.167 | 113.167 | 70.167 | 8 |
| 6 | 27.458 | 14.625 | 3.367 | 87.333 | 110.083 | 67.083 | 7 |
| 7 | 27.625 | 13.625 | 3.100 | 91.500 | 107.000 | 64.000 | 6 |
| 8 | 27.792 | 12.625 | 2.833 | 95.667 | 103.917 | 60.917 | 5 |
| 9 | 27.958 | 11.625 | 2.567 | 99.833 | 100.833 | 57.833 | 4 |
| 10 | 28.125 | 10.625 | 2.300 | 104.000 | 97.750 | 54.750 | 3 |
| 11 | 28.292 | 9.625 | 2.033 | 108.167 | 94.667 | 51.667 | 2 |
| 12 | 28.458 | 8.625 | 1.767 | 112.333 | 91.583 | 48.583 | 1 |
| 13 | 28.625 | 7.625 | 1.500 | 116.500 | 88.500 | 45.500 | 0 |

The 6 bit dynamic intensity value normal is generated by normalizing circuit 154 (FIGS. 3 and 8) which treats the most significant 6 bit I, J and K output values as fractional values and thus in effect divides them by 64 at the input to the circuit and then multiplies the result PR7-0 by 64 at the output. The normal values N/ presented to color/intensity mixer 158 on signals PR7-0 can readily be calculated using the normalization formula described previously at each DVG step.

An even more sophisticated graphic representation can be generated by using two or more passes of the vector generator 112 for each vector. During the first pass Gouraud type shading is employed to generate a desired color or hue pattern using texture RAM 156. During the second pass the vector generator 112 is operated in a PHONG shading mode and the more sophisticated PHONG generated intensity vector N is substituted in frame buffer memory 16 for the previously generated Gouraud shading value.

Comments on examples: The above examples of operation of the raster scan graphic image generating system 10 are merely illustrative of the many operating modes which are available. The various mode control options may be combined in any reasonable combination to produce a desired effect. It will be appreciated that in the representative examples certain options were selected such as moving DVG output values in a negative direction by adding negative delta values instead of subtracting positive delta values, and by obtaining the pixel counter starting value as the integer of the major axis delta value instead of rounding up or down, always rounding up or using some other acceptable algorithm. The flexibility of the present system makes a wide range of choices available to the system user.

It is thus apparent that while there has been shown and described a particular example of the raster scan graphic image generating system 10 in accordance with the invention for the purpose of enabling a person skilled in the art to make and use the invention, the invention should not be limited thereto. Accordingly, and modifications, variations or equivalent arrangements within the scope of the attached claims should be considered to be within the scope of the invention.

What is claimed is:

1. A digital vector generator system comprising:

a plurality of spatial vector generators coupled to receive position information representing a visual image and to generate in response thereto data defining a sequence of pixel coordinate points defining a line within a display image; and at least one visual characteristic vector generator coupled to receive visual characteristic information representing the visual image and to operate synchronously with the spatial vector generators to generate in response to the received visual characteristic information visual characteristic vector information corresponding to each pixel coordinate point defined by the data generated by the spatial vector generators; and means for generating a video signal coupled to receive the sequence of pixel coordinate points from each of the spatial vector generators and the visual characteristic vector information from the at least one visual characteristic vector generator and generating a video signal representing the video image in response thereto.

2. A digital vector generator system according to claim 1 above, wherein at least one visual characteristic vector generator includes an absolute value circuit coupled to receive each generated vector value and generate as the vector generator output signal the absolute value of the generated vector value.

3. A digital vector generator system according to claim 1 above, wherein at least one visual characteristic vector generator includes a masking circuit coupled to latch a selected number of most significant digits of a vector output signal generated thereby at a predetermined selected value.

4. A digital vector generator system comprising:

a plurality of spatial vector generators coupled to receive position information representing a visual image and to generate in response thereto data defining a sequence of pixel coordinate points defining a line within a display image; and at least one visual characteristic vector generator coupled to receive visual characteristic information representing the visual image and to operate synchronously with the spatial vector generators to generate in response to the received visual characteristic information visual characteristic vector information corresponding to each pixel coordinate point defined by the data generated by the spatial vector generators; and a dynamic intensity processing circuit coupled to receive the visual characteristic vector information for each pixel coordinate point and generate in response thereto a visual characteristic data representation having one of a plurality of different selectable relationships to the visual characteristic vector information with the one relationship being selected in response to at least one control signal.

5. A digital vector generator system according to claim 4, wherein the dynamic intensity processing circuit includes a pattern shape multiplexer receiving vector information from at least two of the visual characteristic vector generators and outputting in response thereto multiplexed vector information representing one of a plurality of different weighted combinations of the received vector information, the one combination being selected in response to a received pattern shape selection control signal.

6. A digital vector generator system comprising:

a plurality of spatial vector generators coupled to receive position information representing a visual image and to generate in response thereto data defining a sequence of pixel coordinate points defining a line within a display image; and at least two visual characteristic vector generators coupled to receive visual characteristic information representing the visual image and to operate synchronously with the spatial vector generators to generate in response to the received visual characteristic information visual characteristic vector information corresponding to each pixel coordinate point defined by the data generated by the spatial vector generators; and a normalizing circuit coupled to receive the generated visual characteristic vector information and generate normalized intensity information representative of the magnitude of the received vector information in response thereto.

7. A digital vector generator system comprising:

a plurality of spatial vector generators coupled to receive position information representing a visual image and to generate in response thereto data defining a sequence of pixel coordinate points defining a line within a display image;

at least two visual characteristic vector generators coupled to receive visual characteristic information representing the visual image and to operate synchronously with the spatial vector generators in response to the received visual characteristic information visual characteristic vector information corresponding to each pixel coordinate point defined by the data generated by the spatial vector generators; and a normalizing circuit coupled to receive the generated visual characteristic vector information and generate normalized intensity information representative of the square root of the sum of the squares of individual vectors represented by the received visual characteristic vector information.

8. A digital vector generator system according to claim 1 above, wherein the at least one visual characteristic vector generator includes at least two visual characteristic vector generators and further comprising a writeable pattern store coupled to receive the visual characteristic vector information from at least two of the visual characteristic vector generators as address inputs and generate as an output hue data defining a desired pattern of visual color data in accordance with data stored in the pattern store.

9. A digital vector generator system according to claim 8 above, further comprising a normalizing circuit coupled to receive visual characteristic vector information from each of the visual characteristic vector generators and generate in response thereto intensity data representative of a resultant magnitude of the received visual characteristic vector information.

10. A digital vector generator system according to claim 9 above, further comprising a color intensity multiplexer coupled to receive the intensity data from the normalizing circuit and the hue information from the pattern store and generate pixel data commanding the visual characteristics of each pixel as a combination of the hue and intensity data with each having a selectable resolution selected in response to a mode control signal.

11. A digital vector generator system according to claim 8 above, wherein at least two of the digital vector generators each include a masking circuit coupled to latch a selected number of most significant digits of a vector output signal generated thereby at a predetermined selected value.

12. A graphic display digital vector generating system comprising:

at least three spatial vector generators, each coupled to receive information defining a different dimension of a spatial vector within a graphic scene including respectively vertical, horizontal and depth and to respond by generating video disply spatial information defining coordinate values in one dimension of a display for each of a sequence of video display pixel points representing the spatial vector within the graphic scene;

a plurality of visual characteristic vector generators each coupled to receive information defining a different dimension of a visual characteristic vector representing visual characteristics of the spatial vector and to respond by generating visual characteristic information in one dimension for each point of the sequence of video display pixel points representing the spatial vector within the graphic scene; and a visual characteristic processing circuit coupled to receive from each visual characteristic vector generator the visual characteristic information generated thereby and to output for each video display pixel point information representing the visual characteristic thereof.

13. A graphic display digital vector generating system comprising:

a plurality of spatial vector generators, each coupled to receive information defining a different dimension of a spatial vector within a graphic scene and to respond by generating video display spatial information defining coordinate values in one dimension of a display for each of a sequence of video display pixel points representing the spatial vector within the graphic scene;

a plurality of visual characteristic vector generators each coupled to receive information defining a different dimension of a visual characteristic vector representing visual characteristics of the spatial vector and to respond by generating visual characteristic information in one dimension for each point of the sequence of video display pixel points representing the spatial vector within the graphic scene; and a visual characteristic processing circuit coupled to receive from each visual characteristic vector generator the visual characteristic information generated thereby and to output for each video display pixel point information representing the visual characteristic thereof.

14. The graphic display vector generating system according to claim 13 above, wherein there are three visual characteristic vector generators.

15. The graphic display vector generating system according to claim 14 above, wherein one of the visual characteristic vector generators is coupled to receive visual intensity information.

16. The graphic display vector generating system according to claim 15 above, wherein two of the visual characteristic vector generators are coupled to receive color information.

17. The graphic display vector generating system according to claim 13 above, wherein the visual characteristic processing circuit includes a normalizing circuit coupled to receive the generated visual characteristic information from each of the visual characteristic vector generators and to output for each display pixel point information representing a resultant vector which is resultant of the visual characteristic information received from each of the visual characteristic vector generators.

18. A graphic display vector generating system according to claim 17 above, further comprising a pattern shape multiplexer coupled to receive a selection control signal and to receive generated visual characteristic information corresponding to a pixel point from at least two visual characteristic vector generators and to combine the received information in one of a plurality of different predetermined ways selected in response to the selection control signal to generate a pattern store address; and a pattern store storing selected visual characteristic information at each of a plurality of address therein and coupled to receive pattern store addresses, each corresponding to a pixel point, from the pattern shape multipexer and for each received pattern store address to output the selected visual characteristic information stored thereat.

19. The graphic display vector generating system according to claim 18 above, further comprising a multiplex shifter circuit coupled to receive data defining a resultant vector point corresponding to a pixel point from the normalizing circuit and the corresponding selected visual characteristic information from the pattern store and to output a selected combination thereof as data representing a visual display characteristic, data representing a separate visual display characteristic being output for each video display pixel point in the sequence.

20. A digital vector generator system comprising:

a plurality of spatial vector generators coupled to receive position information representing one or more objects in a visual image and to generate in response thereto a sequence of pixel coordinate points defining at least one feature of the one or more objects within a display image; and a plurality of visual characteristic vector generators coupled to receive visual characteristic information representing visual characteristics of the one or more objects in the visual image and to generate in response thereto visual characteristic information defining a visual characteristic of the display image at each of the pixel coordinate points in the sequence of points generated by the plurality of spatial vector generators, and means for generating a video signal representing the display image in response to the generated sequence of pixel coordinate points and the generated visual characteristic information.

* * * * *

UNITED STATES PATENT AND TRADEMARK OFFICE

CERTIFICATE OF CORRECTION

PATENT NO. : 4,808,988

DATED : February 28, 1989

INVENTOR(S) : Gregory Michael Burke et al.

It is certified that error appears in the above-identified patent and that said Letters Patent is hereby corrected as shown below:

Cover page, under U.S. PATENT DOCUMENTS, Patent No. 4,386,349, "Granberg" should read --Granberg et al.--.

Column 1, line 64, "determines" should read --determine--.

Column 2, line 25, "Single" should read --single--.

Column 12, line 4, "RBIN 110" should read --RBIN 100--.

Column 16, line 49, "selective" should read --elective--.

Column 20, line 7, "$(I^2+J^2+K^2)1/2$" should read --$(I^2+J^2+K^2)^{1/2}$--.

Column 25, line 24, "150 component" should read --1/8 component--.

Signed and Sealed this

Tenth Day of October, 1989

*Attest:*

*Attesting Officer*

DONALD J. QUIGG

*Commissioner of Patents and Trademarks*